United States Patent [19]

McCollum et al.

[11] 3,983,028

[45] Sept. 28, 1976

[54] PROCESS FOR RECOVERING UPGRADED PRODUCTS FROM COAL

[75] Inventors: John D. McCollum, Munster, Ind.; Leonard M. Quick, Naperville, Ill.

[73] Assignee: Standard Oil Company, Chicago, Ill.

[22] Filed: July 1, 1974

[21] Appl. No.: 484,592

[52] U.S. Cl. ..... 208/9

[51] Int. Cl.[2] ..... C10G 1/04

[58] Field of Search ..... 208/8, 9, 11

[56] References Cited

UNITED STATES PATENTS

| | | | |
|---|---|---|---|
| 3,558,468 | 1/1971 | Wise | 208/8 |
| 3,586,621 | 6/1971 | Pitchford et al. | 208/214 |
| 3,642,607 | 2/1972 | Seitzer | 208/8 |
| 3,660,269 | 5/1972 | McCawley | 208/8 |
| 3,687,838 | 8/1972 | Seitzer | 208/9 |
| 3,745,108 | 7/1973 | Schuman et al. | 208/10 |
| 3,819,506 | 6/1974 | Seitzer | 208/8 |
| 3,850,738 | 11/1974 | Stewart et al. | 208/8 |

FOREIGN PATENTS OR APPLICATIONS

| | | | |
|---|---|---|---|
| 339,317 | 12/1930 | United Kingdom | 208/8 |

*Primary Examiner*—Delbert E. Gantz
*Assistant Examiner*—James W. Hellwege
*Attorney, Agent, or Firm*—James L. Wilson; Arthur G. Gilkes; William T. McClain

[57] ABSTRACT

A process for recovering and upgrading products from solid coal by contacting the coal with a dense-water-containing fluid at a temperature in the range of from about 600°F. to about 900°F. in the absence of externally supplied hydrogen or other reducing gas and in the presence of a sulfur- and nitrogen-resistant catalyst. The density of water in the water-containing fluid is at least 0.10 grams per milliliter, and sufficient water is present to serve as an effective solvent for the recovered liquids and gases.

25 Claims, 3 Drawing Figures

PROCESS FOR RECOVERING UPGRADED PRODUCTS FROM COAL

BACKGROUND OF THE INVENTION

1. Field of the Invention

This invention involves a process for recovering liquids and gases from solid coal, and simultaneously for cracking and desulfurizing the recovered liquids and desulfurizing the remaining solid coal.

2. Description of the Prior Art

The potential reserves of liquid hydrocarbons and gases contained in subterranean carbonaceous deposits are known to be very substantial and form a large portion of the known energy reserves in the world. It is desirable from an economic standpoint to use coal to produce both liquid and gaseous fuels since coal is relatively inexpensive compared to petroleum crude oil and is quite abundant in constrast to our rapidly dwindling domestic supply of petroleum and natural gas sources. As a result of the increasing demand for light hydrocarbon fractions, there is much current interest in economical methods for recovering liquids and gases from coal on a commercial scale. Various methods for recovering liquids and gases from coal have been proposed, but the principal difficulty with these methods is that the apparatus used for recovering such products from coal is quite complicated and expensive, which renders the recovered products too expensive to compete with petroleum crudes recovered by more conventional methods.

Moreover, the value of liquids recovered from coal is diminished due to the presence of certain contaminants in the recovered liquids. The chief contaminants are sulfurous compounds which cause detrimental effects with respect to various catalysts utilized in a multitude of processes to which the recovered products may be subjected. These contaminants are also undesirable because of their disagreeable odor, corrosive characteristics, and combustion products.

Additionally, as a result of the increasing demand for light hydrocarbon fractions, there is much current interest in more efficient methods for converting the heavier liquid hydrocarbon fractions recovered from coal into lighter materials. The conventional methods of converting heavier hydrocarbon fractions into lighter materials, such as catalytic cracking, coking, thermal cracking and the like, always result in the production of more highly refractory materials.

It is known that such heavier hydrocarbon fractions and such refractory materials can be converted into lighter materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, application of the hydrocracking technique has in the past been fairly limited because of several interrelated problems. Conversion by the hydrocracking technique of heavy hydrocarbon fractions recovered from coal into more useful products is complicated by the presence of certain contaminants in such hydrocarbon fractions. Oils extracted from coal contain sulfurous compounds in exceedingly large quantities. The presence of sulfur-containing compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur hydrocarbon fractions whenever possible. With the necessity of utilizing heavy, high sulfur hydrocarbon fractions in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, disulfides, and as part of complex ring compounds of which thiophene is a prototype. Such sulfur compounds are not susceptible to the conventional chemical treatments found satisfactory for the removal of mercaptans and hydrogen sulfide and are particularly difficult to remove from heavy hydrocarbon materials.

Nitrogen is also undesirable because it effectively poisons various catalytic composites which may be employed in the conversion of heavy hydrocarbon fractions. In particular, nitrogen-containing compounds are effective in suppressing hydrocracking. Moreover, nitrogenous compounds are objectionable because combustion of fuels containing these impurities possibly contributes to the release of nitrogen oxides which are noxious and corrosive and present a serious problem with respect to pollution of the atmosphere. Consequently, removal of the nitrogenous contaminants is most important and makes practical and economically attractive the treatment of contaminated stocks.

However, in order to remove the sulfur or nitrogen or to convert the heavy residue into lighter more valuable products, the heavy hydrocarbon fraction is ordinarily subjected to a hydrocatalytic treatment. This is conventionally done by contacting the hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in heavy hydrocarbon fractions leads to a relatively rapid reduction in the activity of the catalyst to below a practical level. The presence of these materials in the charge stock results in the deposition of metal-containing coke on the catalyst particles, which prevents the charge from coming in contact with the catalyst and thereby, in effect, reduces the catalytic activity. Eventually, the on-stream period must be interrupted, and the catalyst must be regenerated or replaced with fresh catalyst.

Particularly objectionable is the presence of iron in the form of soluble organometallic compounds. Even when the concentration of iron porphyrin complexes and other iron organometallic complexes is relatively small, that is, on the order of parts per million, their presence causes serious difficulties in the refining and utilization of heavy hydrocarbon fractions. The presence of an appreciable quantity of the organometallic iron compounds in feedstocks undergoing catalytic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally, metallic contaminants such as nickel- and vanadium-containing compounds are harmful. When the hydrocarbon fractions are topped to remove the light fractions boiling above about 450°–650°F., the metals are concentrated in the residual bottoms. If the residuum is then further treated, such metals adversely affect catalysts. When the hydrocarbon fraction is used as a fuel, the metals also cause poor performance in industrial furnaces by corroding the metal surfaces of the furnace.

A promising technique for recovering liquids and gases from coal is a process called dense fluid extraction. Separation by dense fluid extraction at elevated temperatures is a relatively unexplored area. The basic principles of dense fluid extraction at elevated temperatures are outlined in the monograph "The Principles of Gas Extraction" by P. F. M. Paul and W. S. Wise, published by Mills and Boon Limited in London, 1971, of which Chapters 1 through 4 are specifically incorporated herein by reference. The dense fluid can be either a liquid or a dense gas having a liquid-like density.

Dense fluid extraction depends on the chages in the properties of a fluid — in particular, the density of the fluid — due to changes in the pressure. At temperatures below its critical temperature, the density of a fluid varies in step functional fashion with changes in the pressure. Such sharp transitions in the density are associated with vapor-liquid transitions. At temperatures above the critical temperature of a fluid, the density of the fluid increases almost linearly with pressure as required by the Ideal Gas Law, although deviations from linearity are noticeable at higher pressures. Such deviations are more marked as the temperature of the fluid is nearer, but still above, its critical temperature.

If a fluid is maintained at a temperature below its critical temperature and at its saturated vapor pressure, two phases will be in equilibrium with each other, liquid X of density C and vapor Y of density D. The liquid of density C will possess a certain solvent power. If the same fluid were then maintained at a particular temperature above its critical temperature and if it were compressed to density C, then the compressed fluid could be expected to possess a solvent power similar to that of liquid X of density C. A similar solvent power could be achieved at an even higher temperature by an even greater compression of the fluid to density C. However, because of the non-ideal behavior of the fluid near its critical temperature, a particular increase in pressure will be more effective in increasing the density of the fluid when the temperature is slightly above the critical temperature than when the temperature is much above the critical temperature of the fluid.

These simple considerations lead to the suggestion that at a given pressure and at a temperature above the critical temperature of a compressed fluid, the solvent power of the compressed fluid should be greater the lower the temperature; and that, at a given temperature above the critical temperature of the compressed fluid, the solvent power of the compressed fluid should be greater the higher the pressure.

Although such useful solvent effects have been found above the critical temperature of the fluid solvent, it is not essential that the solvent phase be maintained above its critical temperature. It is only essential that the fluid solvent be maintained at high enough pressures so that its density is high. Thus, liquid fluids and gaseous fluids which are maintained at high pressures and have liquid-like densities are useful solvents in dense fluid extractions at elevated temperature.

The basis of separations by dense fluid extraction at elevated temperature is that a substrate is brought into contact with a dense, compressed fluid at an elevated temperature, material from the substrate is dissolved in the fluid phase, then the fluid phase containing this dissolved material is isolated, and finally the isolated fluid phase is decompressed to a point where the solvent power of the fluid is destroyed and where the dissolved material is separated as a solid or liquid.

Some general conclusions based on empirical correlations have been drawn regarding the conditions for achieving high solubility of substrates in dense, compressed fluids. For example, the solvent effect of a dense, compressed fluid depends on the physical properties of the fluid solvent and of the substrate. This suggests that fluids of different chemical nature but similar physical properties would behave similarly as solvents. An example is the discovery that the solvent power of compressed ethylene and carbon dioxide is similar.

In addition, it has been concluded that a more efficient dense fluid extraction should be obtained with a solvent whose critical temperature is nearer the extraction temperature than with a solvent whose critical temperature is farther from the extraction temperature. Further since the solvent power of the dense, compressed fluid should be greater the lower the temperature but since the vapor pressure of the material to be extracted should be greater the higher the temperature, the choice of extraction temperature should be a compromise between these opposing effects.

Various ways of making practical use of dense fluid extraction are possible following the analogy of conventional separation processes. For example, both the extraction stage and the decompression stage afford considerable scope for making separations of mixtures of materials. Mild conditions can be used to extract first the more volatile materials, and then more severe conditions can be used to extract the less volatile materials. The decompression stage can also be carried out in a single stage or in several stages so that the less volatile dissolved species separate first. The extent of extraction and of the recovery of product on decompression can be controlled by selecting an appropriate fluid solvent, by adjusting the temperature and pressure of the extraction or decompression, and by altering the ratio of substrate-to-fluid solvent which is charged to the extraction vessel.

In general, dense fluid extraction at elevated temperatures can be considered as an alternative, on the one hand, to distillation and, on the other hand, to extraction with liquid solvents at lower temperatures. A considerable advantage of dense fluid extraction over distillation is that it enables substrates of low volatility to be processed. Dense fluid extraction even offers an alternative to molecular distillation, but with such high concentrations in the dense fluid phase that a marked advantage in throughput should result. Dense fluid extraction would be of particular use where heat-labile substrates have to be processed since extraction into the dense fluid phase can be effected at temperatures well below those required by distillation.

A considerable advantage of dense fluid extraction at elevated temperatures over liquid extraction at lower temperatures is that the solvent power of the compressed fluid solvent can be continuously controlled by adjusting the pressure instead of the temperature. Having available a means of controlling solvent power by pressure changes gives a new approach and scope to solvent extraction processes.

Zhuze was apparently the first to apply dense fluid extraction to chemical engineering operations in a scheme for de-asphalting petroleum fractions using a propane-propylene mixture as gas, as reported in Vestnik Akad. Nauk S.S.S.R. 29 (11), 47–52 (1959); and in Petroleum (London) 23, 298–300 (1960).

Apart from Zhuze's work, there have been few detailed reports of attempts to apply dense fluid extraction techniques to substrates of commercial interest. British Pat. No. 1,057,911 (1964) describes the principles of gas extraction in general terms, emphasizes its use as a separation technique complementary to solvent extraction and distillation, and outlines multistage operation. British Pat. No. 1,111,422 (1965) refers to the use of gas extraction techniques for working up heavy petroleum fractions. A feature of particular interest is the separation of materials into residue and extract products, the latter being free from objectionable inorganic contaminants such as vanadium. The advantage is also mentioned in this patent of cooling the gas solvent at subcritical temperatures before recycling it. This converts it to the liquid form which requires less energy to pump it against the hydrostatic head in the reactor than would a gas. French Pat. Nos. 1,512,060 (1967) and 1,512,061 (1967) mention the use of gas extraction on petroleum fractions. In principle, these seem to follow the direction of the earlier Russian work.

Pevere, et al., U.S. Pat. No. 2,665,390 (1948) describes in general terms a process for dissolving coal in liquid solvents at high temperatures and then atomizing the solution into a carbonizer but does not mention the use of supercritical conditions. U.S. Defensive Publication 700,485 (filed Jan. 25, 1968) refers to the use of a gas extractant to recover, from a solution of coal in a liquid solvent a fraction suitable as a feedstock for hydrocracking to gasoline.

Seitzer, U.S. Pat. No. 3,642,607 (1972) discloses a process for dissolving bituminous coal by heating a mixture of bituminous coal, a hydrogen donor oil, carbon monoxide, water, and an alkali metal hydroxide or its precursor at a temperature of about 400°—450°C. and under a total pressure of at least about 4000 pounds per square inch gauge.

Seitzer, U.S. Pat. No. 3,687,838 (1972) discloses the same process as disclosed in U.S. Pat. No. 3,642,607 (1972) but employs an alkali metal or ammonium molybdate instead of an alkali metal hydroxide or its precursor.

Urban, U.S. Pat. No. 3,796,650 (1974) discloses a process for de-ashing and liquefying coal which comprises contacting comminuted coal with water, at least a portion of which is in the liquid phase, an externally supplied reducing gas and a compound selected from ammonia and carbonates and hydroxides of alkali metals, at liquefaction conditions, including a temperature of 200°–370°C. to provide a hydrocarbonaceous product.

There have also been numerous references to processes for cracking, desulfurizing, denitrifying, demetalating, and generally upgrading hydrocarbon fractions by processes involving water. For example, Gatsis, U.S. Pat. No. 3,453,206 (1969) discloses a multi-stage process for hydrorefining heavy hydrocarbon fractions for the purpose of eliminating and/or reducing the concentration of sulfurous, nitrogenous, organometallic, and asphaltenic contaminants therefrom. The nitrogenous and sulfurous contaminants are converted to ammonia and hydrogen sulfide. The stages comprise pretreating the hydrocarbon fraction in the absence of a catalyst, with a mixture of water and externally supplied hydrogen at a temperature above the critical temperature of water and a pressure of at least 100 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium, rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800°F. and at a pressure in the range of from about 1000 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acidic carrier component having cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with a nickel spinel catalyst promoted with a barium salt of an organic acid in the presence of steam. A temperature in the range of from 600°F. to about 1000°F. and a pressure in the rage of from 200 to 3000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range from about 0.1 to about 5. At least the first of the components of the catalyst system promotes the generation of hydrogen by reaction of water in the water gas shift reaction and at least the second of the components of the catalyst system promotes reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750°F. to about 850°F. and at a pressure of from about 300 to about 4000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750°F. and 850°F. and at a pressure between atmospheric and 100 pounds per square inch gauge, cooling the dispersion after at least one-half hour to form a stable water-asphaltene emulsion, separating the emulsion from the treated oil, adding hydrogen, and contacting the resulting treated oil with a hydrogenation catalyst at a temperature between 500°F. and 900°F. and at a pressure between about 300 and 3000 pounds per square inch gauge.

It has also been announced that the semi-governmental Japan Atomic Energy Research Institute, working with the Chisso Engineering Corporation, has developed what is called a "simple, low-cost, hot-water, oil desulfurization process" said to have "sufficient commercial applicability to compete with the hydrogenation process." The process itself consists of passing oil through a pressurized boiling water tank in which water is heated up to approximately 250°C., under a pressure of about 100 atmospheres. Sulfides in oil are than separated when the water temperature is reduced to less than 100°C.

Thus far, no one has disclosed the method of this invention for recovering liquids and gases from coal, cracking and desulfurizing the recovering liquids and gases from coal, cracking and desulfurizing the recovered liquids, and desulfurizing the remaining solid coal, which permits operation at lower than conventional temperatures, without an external source of hydrogen or other reducing gas, and without preparation or pretreatment, such as desalting, denitrification or demetalation, prior to upgrading the recovered liquids.

SUMMARY OF THE INVENTION

This invention is a process for recovering liquids and gases from coal solids and simultaneously for cracking and desulfurizing the recovered liquids and desulfurizing the remaining solid coal, which comprises contacting the coal solids with a water-containing fluid at a temperature in the rage of from about 600°F. to about 900°F. in the absence of externally supplied hydrogen or other reducing gas such as carbon monoxide and in the presence of an externally supplied catalyst system containing a sulfur- and nitrogen-resistant catalyst selected from the group consisting of at least one soluble or insoluble transition metal compound, a transition metal deposited on a support, and combinations thereof. The density of water in the water-containing fluid is at least 0.10 gram per milliliter, and sufficient water is present to serve as an effective solvent for the recovered liquids and gases.

The water-containing fluid can contain an organic material which is preferably selected from the group consisting of biphenyl, pyridine, a highly saturated oil, an aromatic oil, a partly hydrogenated aromatic oil, and a mono- or polyhydric compound, which is more preferably selected from the group consisting of biphenyl, pyridine, a highly saturated oil, and a mono- or polyhydric compound, and which is most preferably a highly saturated oil.

The density of water in the water-containing fluid is preferably at least 0.15 gram per milliliter and most preferably at least 0.2 gram per milliliter. The temperature is preferably at least 705°F., the critical temperature of water. The coal solids and water-containing fluid are contacted preferably for a period of time in the range of from about 1 minute to about 6 hours, more preferably in the range of from about 5 minutes to about 3 hours and most preferably in the range of from about 10 minutes to about 1 hour. The weight ratio of the coal solids-to-water in the water containing fluid is preferably in the range of from about 3:2 to about 1:10 and more preferably in the range of from about 1:1 to about 1:3. The water-containing fluid is preferably substantially water and more preferably water. The coal solids have preferably a maximum particle size of one-half inch diameter, more preferably a maximum particle size of one-quarter inch diameter and most preferably a maximum particle size of 8 mesh.

The catalyst preferably is selected from the group consisting of ruthenium, rhodium, iridium, osmium, paladium, nickel, cobalt, platinum, and combinations thereof and most preferably is selected from the group consisting of ruthenium, rhodium, iridium, osmium, and combinations thereof. The catalyst is present in a catalytically effective amount which is equivalent to a concentration level in the water in the water-containing fluid in the range of from about 0.02 to about 1.0 weight percent and preferably in the range from about 0.05 to about 0.15 weight percent.

Preferably the catalyst system contains additionally a promoter selected from the group consisting of at least one basic metal hydroxide, basic metal carbonate, transition metal oxide, oxide-forming transition metal salt and combinations thereof. The promoter promotes the activity of the catalyst. The transition metal in the oxide and salt is preferably selected from the group consisting of a transition metal of Group IVB, VB, VIB, and VIIB of the Periodic Chart and is more preferably selected rom the group consisting of vanadium, chromium, manganese, titanium, molybdenum, zirconium, niobium, tantalum, rhenium, and tungsten and is most preferably selected from the group consisting of chromium, manganese, titanium, tantalum and tungsten.

The metal in the basic metal carbonate and hydroxide is preferably selected from the group consisting of alkali and alkaline earth metals and more preferably is selected from the group consisting of sodium and potassium. The ratio of the number of atoms of metal in the promoter to the number of atoms of metal in the catalyst is preferably in the range of from about 0.5 to about 50 and most preferably in the range of from about 3 to about 5.

DETAILED DESCRIPTION

Figure 1:
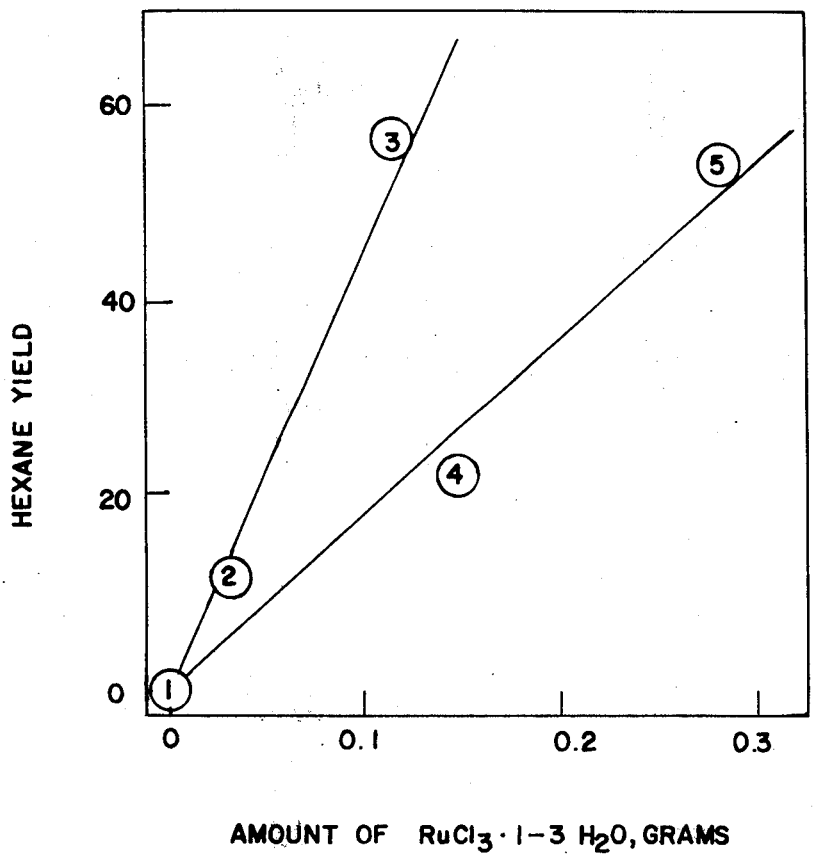
FIG. 1 is a series of plots showing the effect on the formation of hexane from 1-hexene of varying amounts of a catalyst in the presence of a fixed amount of a promoter.

It has been found that liquids and gases can be recovered from coal solids, that the recovered liquids can be upgraded, cracked and desulfurized, and that the remaining solid coal can be desulfurized by contacting the coal solids with a dense-water-containing phase, either gas or liquid, at a reaction temperature in the range of from about 600°F. to about 900°F. in the absence of externally supplied hydrogen or other reducing gas such as carbon monoxide and in the presence of an externally supplied catalyst system containing a sulfur- and nitrogen-resistant catalyst.

We have found that, in order to effect the recovery of liquids and gases from coal, in order to effect the chemical conversion of the recovered hydrocarbons into lighter, more useful hydrocarbon fractions, and in order to desulfurize the remaining solid coal by the method of this invention — which involves processes characteristically occurring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

The high solvent power of dense fluids is discussed in the monograph "The Principles of Gas Extraction" by P. F. M. Paul and W. S. Wise, published by Mills and Boon Limited in London, 1971. For example, the difference in the solvent power of steam and of dense gaseous water maintained at a temperature in the region of the critical temperature of water and at an elevated pressure is substantial. Even normally insoluble inorganic materials such as silica ad alumina, commence to dissolve appreciably in "supercritical water" — that is, water maintained at a temperature above the critical temperature of water — so long as a high water density is maintained.

Enough water must be employed so that there is sufficient water in the dense-water-containing phase to serve as an effective solvent for the recovered liquids and gases. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter.

We have found that, with the limitations imposed by the size of the reaction vessels we employed in this work, a weight ratio of the coal solids-to-water in the dense-water-containing phase in the range of from about 3:2 to about 1:10 is preferable, and a weight ratio in the range of from about 1:1 to about 1:3 is more preferable.

A particularly useful water-containing fluid contains water in combination with an organic compound such as biphenyl, pyridine, a highly saturated oil, an aromatic oil, a partly hydrogenated aromatic oil, or a mono- or polyhydric compound such as methyl alcohol. The use of such combinations extends the limits of solubility and rates of dissolution so that cracking and desulfurization can occur even more readily. Furthermore, the component other than water in the dense-water-containing phase can serve as a source of hydrogen, for example, by reaction with water.

The catalyst employed in the method of this invention is effective when added in an amount equivalent to a concentration in the water of the water-containing fluid in the range from about 0.02 to about 1.0 weight percent and preferably in the range of from about 0.05 to about 0.15 weight percent.

If the catalyst is not soluble in the water-containing fluid, then it may be added as a solid and slurried in the reaction mixture. Alternately, the catalyst can be deposited on a support and slurried in the water-containing fluid. Charcoal, active carbon, alundum, and oxides such as silica, alumina, manganese dioxide, and titanium dioxide have been used successfully as supports for insoluble catalysts. However, high surface-area silica and alumina have only been satisfactory supports at reaction temperatures lower than the critical temperature of water.

Any suitable conventional method for depositing a catalyst on a support known to those in the art can be used. One suitable method involves immersing the support in a solution containing the desired weight of catalyst dissolved in a suitable solvent. The solvent is then removed, and the support with the catalyst deposited thereon is dried. The support and catalyst are then calcined in an inert gas stream at about 500°C. for from 4 to 6 hours. The catalyst can then be reduced or oxidized as desired.

This process can be performed either as a batch process or as a continuous or semi-continuous flow process. Contact times between the coal solids and the dense-water-containing phase — that is, residence time in a batch process or inverse solvent space velocity in a flow process — of from the order of minutes up to about 6 hours are satisfactory for effectivee cracking andd desulfurization of the recovered products.

In the method of this invention, the water-containing fluid and the coal solids are contacted by making a slurry of the coal solids in the water-containing fluid.

When the method of this invention is performed above ground with mined coal, the desired products can be recovered more rapidly if the mined solids are ground to a particle size preferably ½-inch diameter or smaller. Alternately, the method of this invention could also be performed in situ in subterranean deposits by pumping the water-containing fluid into the deposit and withdrawing the recovered products for separation or further processing.

EXAMPLES 1–22

Examples 1–22 involve batch processing of coal feeds under a variety of conditions and illustrate that liquids and gases are recovered, that the recovered liquids are cracked andd desulfurized, and that the remaining solid coal is desulfurized in the method of this invention. Unless otherwise specified, the following procedure was used in each case. The coal feed, water-containing fluid, and components of the catalyst system, if used, were loaded at ambient temperature into a 300 milliliter Hastelloy alloy C Magne-Drive batch autoclave in which the reaction mixture was to be mixed. The components of the catalyst system were added as solvents in the water-containing fluid or as solids in slurries in the water-containing fluid. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 minutes were required to raise the temperature from 660°F. to 700°F. Approximately another 6 minutes were required to raise the temperature from 700°F. to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized by flash-distilling from the reaction vessel, removing the argon, gas products, water, and "oil", and leaving the "bitumen," solid residue, and catalyst, if present, in the reaction vessel. The oil was the liquid hydrocarbon fraction boiling at or below the reaction temperature and the bitumen was the liquid hydrocarbon fraction boiling above the reaction temperature. The solid residue was remaining solid coal.

The argon, gas products, water, and oil were trapped in a pressure vessel cooled by liquid nitrogen. The argon and gas products were removed by warming the pressure vessel to room temperature, and then the gas products were analyzed by mass spectroscopy, gas chromatography, and infra-red. The water and oil were then purged from the pressure vessel by means of compressed gas and occasionally also by heating the vessel. Then the water and oil were separated by decantation. The oil was analyzed for its sulfur content using X-ray fluorescence.

The bitumen, solid residue, and catalyst, if present, were washed from the reaction vessel with chloroform, and the bitumen dissolved in this solvent. The solid residue and catalyst, if present, were then separated from the solution containing the bitumen by filtration. The bitumen and solids were analyzed for their sulfur contents using the same method as in the analysis of the oil.

The weights of the various components or fractions added and recovered were determined either directly or indirectly by difference at various stages during the procedure.

Three samples of coal were used in this work. The samples were obtained in the form of lumps, which were then ground and sieved to obtain fractions of various particle sizes. The particle size and moisture and sulfur contents of each sample used are presented in Table 1. Samples A and B were obtained from Commonwealth Edison Company, while sample C was an Illinois number 6 seam coal obtained from Hydrocarbon Research Incorporated. Sample A was a sub-bituminous coal, while samples B and C were highly volatile bituminous coals. These samples were stored under a blanket of argon until used.

Examples 1–22 involve batch recovery of liquids and gases from the coal samples shown in Table 1 using the method described above. These runs were performed in a 300-milliliter Hastelloy alloy C Magne-Drive autoclave. The experimental conditions and the results obtained in these Examples are presented in Tables 2 and 3, respectively.

In these Examples, the liquid hydrocarbon products were classified either as oils or as bitumens depending on whether or not such liquid products could be flashed from the autoclave upon depressurization of the autoclave at the run temperature employed. Oils were those liquid products which flashed over at the run temperature, while bitumens were those liquid products which remained in the autoclave.

The weight balance shown in Table 3 was obtained by dividing the sum of the weights of the gas, liquid, and solid products recovered and of the weights of the water, argon and catalyst, if used, recovered by the sum of the weights of the coal, water, co-solvent, argon, and catalyst, if used, initially charged to the autoclave. The product composition, reported as a weight percent on a moisture-free basis, was calculated by dividing the weight of the particular product in grams by the difference between the weight of the coal feed in grams and its moisture content in grams. The percent of coal conversion is 100 minus the weight percent of solid recovered.

The results shown in Table 3 illustrate that substantial conversion of coal solids occurred with both bituminous and sub-bituminous coal using the method of this invention.

TABLE 1

| Coal Sample | Particle Size[1] | Moisture Content[2] | Sulfur Content[3] |
|---|---|---|---|
| A | 10–40 | 22.2 | 0.74 |
| B | 10–40 | 9.7 | 4.5 |
| C[4] | ≥80 | 2.7 | 4.9 |

[1]mesh size.
[2]weight percent.
[3]weight percent, on a moisture-free basis.
[4]pre-dried.

TABLE 2

| Ex. | Coal Sample[1] | Reaction Temperature[2] | Reaction Time[3] | Reaction Pressure[4] | Argon Pressure[4] | Amount of Water Added[5] | Coal-to Water weight Ratio | Amount of co-solvent Added[5] | Amount of $RuCl_3 \cdot 1\text{-}3H_2O$ Added[5] |
|---|---|---|---|---|---|---|---|---|---|
| 1 | A | 752 | 3 | 4200 | 350 | 90 | .56 | — | — |
| 2 | B | 752 | 3 | 4250 | 250 | 90 | .56 | — | — |
| 3 | C | 689 | 2 | 3700 | 450 | 150 | .33 | — | — |
| 4 | C | 752 | 2 | 4450 | 400 | 90 | .56 | — | — |
| 5 | C | 750 | 2 | 4300 | 250 | 85 | .59 | 5[6] | — |
| 6 | C | 752 | 2 | 4300 | 250 | 100 | .20 | — | — |
| 7 | C | 752 | 2 | — | 250 | 90 | .22 | 20[7] | — |
| 8 | C | 752 | 2 | 4550 | 250 | 90 | .22 | 40[8] | — |
| 9 | — | 752 | 2 | 4550 | 250 | 90 | 0 | 40[8] | — |
| 10 | — | 752 | 2 | 4300 | 250 | 90 | 0 | 40[9] | — |
| 11 | C | 752 | 2 | 4300 | 250 | 90 | .22 | 20[9] | — |
| 12 | — | 752 | 2 | 4300 | 250 | 90 | 0 | 40[9] | — |
| 13 | — | 752 | 2 | 4150 | 250 | 90 | 0 | 30[10] | — |
| 14 | C | 752 | 2 | 4200 | 250 | 90 | .22 | 20[10] | — |
| 15 | B | 752 | 2 | 4300 | 250 | 90 | .22 | 20[10] | — |
| 16 | A | 752 | 3 | 4325 | 250 | 90 | .56 | — | .15 |
| 17 | B | 752 | 3 | 4250 | 250 | 90 | .56 | — | .15 |
| 18[11] | A | 752 | 2 | 4200 | 250 | 88.7 | .56 | — | .15 |
| 19 | C | 752 | 2 | 4400 | 250 | 90 | .56 | — | .15 |
| 20 | C | 752 | 2 | 4150 | 250 | 90 | .56 | — | .15[12] |
| 21 | C | 752 | 2 | 4050 | 250 | 85 | .59 | 5[6] | .15[13] |
| 22 | C | 752 | 2 | 4300 | 300 | 90 | .22 | 20[8] | .15[13] |

[1]The samples corresponding to the letters are identified in Table 1.
[2]°F.
[3]hours.
[4]pounds per square inch guage.
[5]grams.
[6]Methyl alcohol is the co-solvent.
[7]Biphenyl is the co-solvent.
[8]The co-solvent is a highly saturated, solvent extracted base oil, containing no sulfur, 4.5 weight percent of aromatic carbon atoms, and 33.7 weight percent of naphthenic carbon atoms, and having an API gravity of 32.1° and a density of 0.863 gram per milliliter.
[9]The co-solvent is a highly saturated, hydrofinished white oil containing no sulfur, no aromatic carbon atoms, and 44.3 weight percent of naphthenic carbon atoms, and having an API gravity of 28.2° and a density of 0.833 gram per milliliter.
[10]The co-solvent is decanted oil, an aromatic waste product removed catalytic cracker cyclones, containing 3.5 weight percent of sulfur and 51 weight percent of aromatic carbon atoms and having an API gravity of 1.8°.
[11]Additionally, 1.2 grams of 85 weight percent of phosphoric acid in water were added.
[12]The catalyst system additionally included .10 gram of $IrCl_3 \cdot 1\text{-}3H_2O$ as catalyst and .30 gram of sodium carbonate as promoter.
[13]The catalyst system additionally included .30 gram of sodium carbonate as promoter.

TABLE 3

| Example | Product Composition[1] | | | | Product Composition[2] | | | | Weight Percent of Coal Conversion | Sulfur Content[3] | | | Weight Balance |
|---|---|---|---|---|---|---|---|---|---|---|---|---|---|
| | Gas | Oil | Bitumen | Solid[4] | Gas | Oil | Bitumen | Solid[4] | | Oil | Bitumen | Solid | |
| 1 | 5.2 | 4.3 | 3.6 | 26.3 | 13 | 11 | 9.3 | 68 | 32 | — | — | — | 103.4 |
| 2 | 3.2 | 4.5 | 2.6 | 34.3 | 7.1 | 10 | 5.8 | 76 | 24 | — | — | 24 | 101.2 |
| 3 | 7.4 | 1.3 | 7.7 | 36.2 | 15 | 2.7 | 16 | 74 | 26 | — | — | — | — |
| 4 | 3.6 | 6.0 | 1.7 | 34.9 | 7.4 | 12 | 3.5 | 72 | 28 | — | — | 2.8 | 105.1 |
| 5 | 6.9 | 5.4 | 0.6 | 37.0 | — | — | — | 76 | 24 | — | — | — | 100.9 |
| 6 | 1.1 | 5.6 | 0.6 | 14.0 | 5.7 | 29 | 3.1 | 72 | 28 | 3.1 | — | 2.2 | 101.5 |
| 7 | — | 19.1 | 1.1 | 13.6 | — | — | — | 70 | 30 | — | — | — | — |
| 8 | 13.4 | 33.8 | 4.4 | 11.9 | — | — | — | 61 | 39 | — | — | 2.2 | 98.9 |
| 9 | 1.4 | 36.8 | 2.4 | 0 | — | — | — | 0 | 0 | — | — | — | 102.4 |
| 10 | 3.3 | 13.2 | 20.4 | 0 | — | — | — | 0 | 0 | — | — | — | 101.4 |
| 11 | 3.3 | 18.9 | 3.9 | 12.1 | — | — | — | 62 | 38 | — | — | 2.2 | 97.9 |
| 12 | 0.9 | 18.8 | 12.4 | 0 | — | — | — | 0 | 0 | — | — | — | 102.0 |
| 13 | 0.6 | 22 | 9 | 0.9 | — | — | — | 0 | 0 | — | — | — | 106.0 |
| 14 | 1.0 | 18.8 | 4.8 | 15.2 | — | — | — | 78 | 22 | — | — | — | 99.5 |
| 15 | 2.3 | 41.6 | 4.0 | 15.6 | — | — | — | 86 | 14 | — | — | — | 101.0 |
| 16 | 6.0 | 3.6 | 1.6 | 26.1 | 15 | 9 | 4.1 | 67 | 33 | — | — | — | 101.7 |
| 17 | 2.8 | 2.6 | 2.1 | 35.2 | 6.2 | 5.8 | 4.7 | 78 | 22 | 1.0 | 1.1 | 2.4 | 98.9 |
| 18 | 4.6 | 4.6 | 0.7 | 33.5 | 12 | 12 | 1.8 | 86 | 14 | — | — | — | 106.5 |
| 19 | 0.9 | 7.5 | 2.2 | 36.7 | 1.8 | 15 | 4.5 | 75 | 25 | — | — | — | 99.1 |
| 20 | 3.8 | 9.4 | 0.9 | 37.7 | 7.8 | 19 | 1.8 | 77 | 23 | — | — | — | 100.9 |
| 21 | 4.5 | 6.1 | 1.6 | 37.4 | — | — | — | 77 | 23 | — | — | — | 100.6 |
| 22 | 3.3 | 20.6 | 1.6 | 13.2 | — | — | — | 68 | 32 | — | — | — | 99.5 |

[1]grams.
[2]weight percent of the coal feed, on a moisture-free basis.
[3]weight percent of the particular product fraction, on a moisture-free basis.
[4]including catalyst, if present.

There was also substantial desulfurization in each case where the sulfur content of the products was determined. Addition of a catalyst in the method of this invention in Examples 16 through 22 resulted in an increase in the production of the oil fraction relative to the gas and bitumen fractions.

The results of Examples 9, 10, and 12 indicate that the organic co-solvent made no contribution to the amount of solid product recovered. Therefore, the amount of solid remaining after processing under the conditions of the method of this invention is a good measure of the extent of conversion of solid coal to gas and liquid products, even in the presence of a co-solvent. Generally, the extent of coal conversion increased markedly when a saturated, non-aromatic oil or biphenyl was the co-solvent. No attempt was made to distinguish between the contributions of the coal feed and of the co-solvent to the yields of gas and liquid products, when a co-solvent was used.

EXAMPLES 23–176

Examples 23–176 involve batch processing of different types of hydrocarbon feedstocks under the conditions employed in the method of this invention and illustrate that the method of this invention effectively cracks, hydrogenates, desulfurizes, demetalates, and denitrifies hydrocarbons and therefore that the hydrocarbons recovered from the coal solids are also cracked, hydrogenated, desulfurized, demetalated and denitrified in the method of this invention. Unless otherwise specified, the following procedure was used in each case. The hydrocarbon feed, water-containing fluid, and the components of the catalyst system, if present, were loaded at ambient temperature into a Hastelloy alloy C Magne-Drive or Hastelloy alloy B Magne-Dash autoclave in which the reaction mixture was to be mixed. The components of the catalyst system were added as solutes in the water-containing fluid or as solids in slurries in the water-containing fluid. Unless otherwise specified, sufficient water was added in each Example so that, at the reaction temperature and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 more minutes were required to raise the temperature from 660°F. to 700°F. Approximately, another 6 minutes were required to raise the temperature from 700°F. to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized by flash-distilling from the reaction vessel, removing the argon, gas products, water-containing fluid, and "light" ends, and leaving the "heavy" ends, catalyst, if present, and other solids in the reaction vessel. The light ends were the liquid hydrocarbon fraction boiling at or below the reaction temperature, and the heavy ends were the hydrocarbon fraction boiling above the reaction temperature.

The argon, gas products, water-containing fluid, and light ends were trapped in a pressure vessel cooled by liquid nitrogen. The argon and gas products were removed by warming the pressure vessel to room temperature, and then the gas products were analyzed by mass spectroscopy, gas chromatography, and infra-red. The water-containing phase and light ends were then purged from the pressure vessel by means of compressed gas andd occasionally by heating the vessel. Then the water-containing fluid and light ends were separated by decantation. Alternately, this separation was postponed until a later stage in the procedure. Gas chromatograms were run on the light ends.

The heavy ends and solids, including the catalyst, if present, were washed from the reaction vessel with chloroform, and the heavy ends dissolved in this solvent. The solids, including the catalyst, if present, were then separated from the solution containing the heavy ends by filtration.

After separating the chloroform from the heavy ends by distillation, the light ends and heavy ends were combined. If the water-containing fluid had not already been separated from the light ends, then it was separated from the combined light and heavy ends by centrifugation and decantation. The combined light and heavy ends were analyzed for their nickel, vanadium, and sulfur content, carbon-hydrogen atom ratio (C/H), and API gravity. The water and the solids were analyzed for nickel, vanadium, and sulfur. X-ray fluoresence was used to determine nickel, vanadium, and sulfur.

Examples 23–25 illustrate that the catalysts employed in the method of this invention are not subject to poisoning by sulfur-containing compounds. Three runs were made, each with carbon monoxide in the amount of 350 pounds per square inch gauge in 90 milliliters of water, in a 240-milliliter Magne-Dash autoclave for a reaction time of four hours. Soluble ruthenium trichloride in the amount of 0.1 gram $RuCl_3 \cdot 1\text{-}3H_2O$ was employed as the catalyst in these Examples. Additionally, in Example 24, the water contained 1 milliliter of thiophene. The reaction conditions and the compositions of the products in each run are shown in Table 4. The presence of a sulfur-containing compound, thiophene, did not cause poisoning of the catalyst or inhibition of the water-gas shift.

Example 26 illustrates that the catalyst system operates as a catalyst for the hydrogenation of unsaturated organic compounds. When 15 grams of 1-octene was contacted with 30 grams of water in a 100milliliter Magne-Dash autoclave for 7 hours at a temperature of 662°F. at a reaction pressure of 3500 pounds per square inch gauge and an argon pressure of 800 pounds per square inch gauge, in the presence of soluble $RuCl_3 \cdot 1\text{-}3H_2O$ catalyst, carbon dioxide, hydrogen, methane, octane, cis-and trans-2-octene, and paraffins andd olefins containing five, six, and seven carbon atoms were found in an analysis of the products. These products indicated that substantial cracking and isomerization of the skeleton and of the location of the site of unsaturation occured. A 40% yield of octane was obtained when 15 grams of 1-octene and 30 grams of water were reacted in the presence of 0.1 gram of $RuCl_3 \cdot 1\text{-}3H_2O$ for 3 hours, in the same reactor and at the same temperature, at a reaction pressure of 2480 pounds per square inch gauge and an argon pressure of 200 pounds per square inch gauge. A 75% yield of octane was obtained from the same reaction mixture, in the same reactor, and under the same conditions, but after a reaction time of 7 hours and at a reaction pressure of 3470 pounds per square inch gauge and an argon pressure of 800 pounds per square inch gauge.

Examples 27–28 involve runs wherein sulfur-containing compounds, for example, thiophene andd benzothiophene, are decomposed to hydrocarbons, carbon dioxide, and elemental sulfur. These Examples illustrate the efficiency of the catalyst system in catalyzing the desulfurization of sulfur-containing organic compounds.

TABLE 5

| Analysis | Vacuum Gas Oil | Atmospheric Residual Oils-A C | Atmospheric Residual Oils-A Kafji | Tar Sands Oils Straight | Tar Sands Oils Topped | Atmospheric Residual Oils-B Khafji | Atmospheric Residual Oils-B C | Atmospheric Residual Oils-B Cyrus | C Vacuum Residual Oil-B |
|---|---|---|---|---|---|---|---|---|---|
| Sulfur[1] | 2.56 | 3.6 | 4.3 | 4.56 | 5.17 | 3.89 | 3.44 | 5.45 | 4.64 |
| Vanadium[2] | | 30 | 84 | 182 | 275 | 93 | 25 | 175 | 54 |
| Nickel[2] | | 14 | 30 | 74 | 104 | 31 | 16 | 59 | 34 |
| Carbon[1] | | | | 83.72 | 82.39 | 84.47 | 85.04 | 84.25 | 84.88 |
| Hydrogen[1] | | | | 10.56 | 9.99 | 10.99 | 11.08 | 10.20 | 10.08 |
| H/C atom ratio | | | | 1.514 | 1.455 | 1.56 | 1.56 | 1.45 | 1.43 |
| API gravity[3] | | | | 12.2 | 7.1 | 14.8 | 15.4 | 9.8 | 5.4 |
| Fraction boiling[1] lower than 650°F. | 15 | 15 | 15 | 20.4 | 9.7 | 10.0 | 12.0 | 6.9 | 9.1 |

[1]weight percent.
[2]parts per million.
[3]°API.

TABLE 4

| Ex. | Reaction Temp.(°F.) | Reaction Pressure[1] | Product Composition[2] $H_2$ | $CO_2$ | CO |
|---|---|---|---|---|---|
| 23 | 670 | 2500 | 39 | 32 | 29 |
| 24 | 662 | 2500 | 25 | 23 | 52 |
| 25 | 662 | 2550 | 26 | 22 | 52 |

[1]pounds per square inch gauge.
[2]normalized mole percent of gas.

In Example 27, a reaction mixture of 12 milliliters of thiophene and 90 milliliters of water reacted in a 240-milliliter Magne-Dash autoclave in the presence of 0.1 gram of soluble $RuCl_3 \cdot 1\text{-}3H_2O$ catalyst at a reaction temperature of 662°F., under a reaction pressure of 3150 pounds per square inch gauge and an argon pressure of 650 pounds per square inch gauge, and for a reaction time of 4 hours to yield $C_1$ to $C_4$ hydrocarbons and 0.1 gram of solid elemental sulfur but no detectable amounts of sulfur oxides or hydrogen disulfide.

In Example 28, a mixture of 23 milliliters of a solution of 8 mole percent thiophene (that is, about 3 weight percent sulfur) in 1-hexene and 90 milliliters of water reacted in a 240-milliliter Magne-Dash autoclave in the presence of 2 grams of solid alumina support containing 5 weight percent of ruthenium (equivalent to 0.1 gram of $RuCl_3 \cdot 1\text{-}3H_2O$) at a reaction temperature of 662°F., under a reaction pressure of 3500 pounds per square inch gauge and an argon pressure of 600 pounds per square inch gauge, and for a reaction time of 4 hours to yield hydrocarbon products containing sulfur in the amount of 0.9 weight percent of the hydrocarbon feed and in the form of thiophene. This decrease in thiophene concentration corresponds to a 70% desulfurization. The activity of the catalyst was undiminished through 4 successive batch runs.

Examples 29–36 involve the processing of samples of vacuum gas oil and residual fuels and illustrate that the catalyst system effectively catalyzes the desulfurization, demetalation, cracking and upgrading of hydrocarbon fractions. The compositions of the hydrocarbon feeds used are shown in Table 5. The residual oils used in these Examples are designated by the letter A in Table 5.

Examples 29–32 involve vacuum gas oil; Examples 33–34 involve C atmospheric residual oil; and Examples 35–36 involve Kafji residual oil. Example 29 involves vacuum gas oil under similar conditions as those used in Examples 30–31 but in the absence of catalyst, and is presented for the purpose of comparison.

The experimental conditions, product composition, and extent of sulfur, nickel, and vanadium removal in these Examples are shown in Table 6. The liquid products are characterized as lower boiling or higher boiling depending whether they boil at or below the reaction temperature or above the reaction temperature, respectively. The reaction temperature was 715°F., and a 300-milliliter Hastelloy alloy B Magne-Dash autoclave was used in each Example. Ruthenium, rhodium, and osmium were added in the form of soluble $RuCl_3 \cdot 1\text{-}3H_2O$, $RhCl_3 \cdot 3H_2O$, and $OsCl_3 \cdot 3H_2O$, respectively. The percents of sulfur, nickel, and vanadium removal are reported as the percents of the sulfur, nickel, and vanadium content of the hydrocarbon feed removal from the product.

Comparison of the results in Table 6 indicates that even thermal processing without the addition of catalyst from an external source causes considerable cracking and upgrading and a small amount of desulfurization of the hydrocarbon fraction. With a relatively high oil-to-water weight ratio, the compositions of the products obtained from thermal processing and from processing in the presence of a ruthenium catalyst are similar. With a lower oil-to-water weight ratio, analysis of the products reveals more extensive cracking in the presence of a ruthenium catalyst. Moreover, under similar conditions and with a ruthenium or a rhodium-osmium combination catalyst, there is essentially complete conversion of liquid feed into gases and liquid products boiling at temperatures equal to or less than the reaction temperature.

Examples 37–38 involve promoters for the catalyst system of this invention. Basic metal hydroxides and carbonates and transistion metal oxides, preferably oxides of metals in Groups IVB, VB, VIB, and VIIB of the Periodic Chart, do not function as catalysts for the water-reforming process, to be described below, but do effectively promote the activity of the catalysts of this invention which do catalyze water-reforming.

The promoter may be added as a solid and slurried in the reaction mixture or as a water-soluble salt, for example manganese chloride or potassium permanganate, which produces the corresponding oxide under the conditions employed in the method of this invention.

TABLE 6

| | Example 29 | Example 30 | Example 31 | Example 32 | Example 33 | Example 34 | Example 35 | Example 36 |
|---|---|---|---|---|---|---|---|---|
| Reaction pressure[1] | 2700 | 2300 | 3500 | 3700 | 3650 | 3775 | 3630 | 3650 |
| Argon pressure[1] | 450 | 450 | 300 | 450 | 400 | 450 | 400 | 400 |
| Reaction time[2] | 7 | 6 | 6 | 2 | 16 | 16 | 13 | 13 |
| Oil-to-water weight ratio | 5.4 | 6 | 0.2 | 0.3 | 0.3 | 0.3 | 0.3 | 0.3 |
| Water added[3] | 20 | 20 | 96 | 90 | 96 | 96 | 96 | 96 |
| Catalyst | None | Ru | Ru | Os + Rh | Ru | Os | Ru | Os |
| Catalyst concentration[4] | — | 0.03 | 0.04 | 0.07 + 0.03 | 0.03 | 0.09 | 0.03 | 0.09 |
| Product Composition[5] | | | | | | | | |
| Gas | 3 | 4 | 11 | 21 | 12 | 22 | 10 | 10 |
| Lower boiling liquid | 49 | 46 | 79 | 79 | 50 | — | 22 | 30 |
| Higher boiling liquid | 48 | 50 | 10 | 0 | 32 | — | 68 | 51 |
| Sulfur content[6] | 2.36 | 2.25 | 1.97 | 2.08 | 2.0 | 2.6 | 2.8 | 3.4 |
| Nickel content[6,7] | — | — | — | — | 9 | — | 10 | 2 |
| Vanadium content[6,7] | — | — | — | — | 6 | — | 16 | 9 |
| Percent sulfur removal | 8 | 12 | 23 | 20 | 48 | 28 | 34 | 20 |
| Percent nickel removal | — | — | — | — | 36 | — | 67 | 93 |
| Percent vanadium removal | — | — | — | — | 80 | — | 81 | 89 |

[1]pounds per square inch gauge.
[2]hours.
[3]grams.
[4]The amounts of catalyst added are presented in grams and in the same order in which the corresponding catalysts are listed.
[5]weight percent of the hydrocarbon feed except where otherwise indicated.
[6]obtained from an analysis of the combined liquid fractions.
[7]parts per million.

Alternately, the promoter can be deposited on a support and used as such in a fixed-bed flow configuration or slurried in the water-containing fluid. The ratio of the number of atoms of metal in the promoter to the number of atoms of metal in the catalyst is in the range of from about 0.5 to about 50 and preferably from about 3 to about 5.

The yields of the products of the water-reforming process are good indicators or promotional activity. In the water-reforming process, hydrogen and carbon monoxide are formed in situ by the reaction of part of the hydrocarbon feed with water under the conditions of the method of this invention. The carbon monoxide produced reacts with water forming carbon dioxide and additional hydrogen in situ in the water gas shift. The hydrogen thus generated then reacts with part of the hydrocarbon feed to form saturated materials. Additionally some hydrocarbon hydrocracks to form methane. Thus, the yields of saturated product, carbon dioxide, and methane are good measures of the promotional activity when a promoter is present in the catalyst system.

Figure 2:
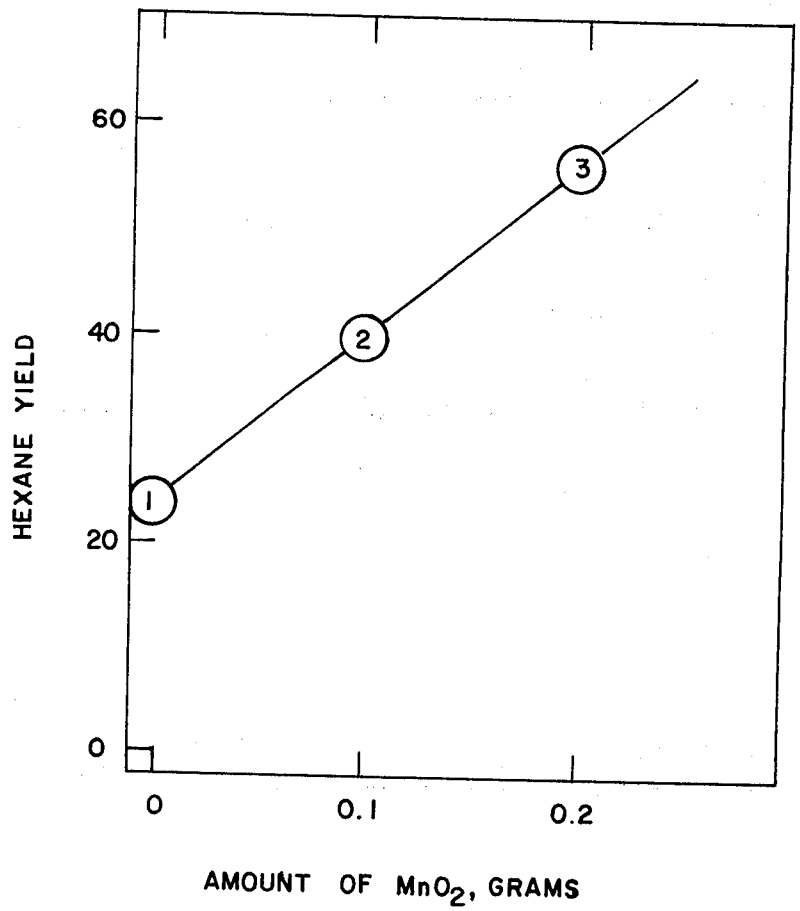
FIG. 2 is a plot showing the effect on the formation of hexane from 1-hexene of varying amounts of a promoter in the presence of a fixed amount of a catalyst.

The yields of hexane obtained by processing 1-hexene in Examples 37 and 38 are presented in FIGS. 1 and 2, respectively. The hexane yield is shown in terms of the mole percent of 1-hexene feed which is converted to hexane in the product.

In Examples 37 and 38, a reaction temperature of 662°F., a reaction time of 2 hours, 90 grams of water, 17 ± 0.5 grams of 1-hexene, and a 300-milliliter Hastelloy alloy B Magne-Dash autoclave were employed. In FIG. 1, the runs from which points labelled 1 through 5 were obtained employed reaction pressures of 3450, 3400, 2800, 3450, and 3500 pounds per square inch gauge, respectively, and argon pressures of 650, 650, 0, 620, and 620 pounds per square inch gauge, respectively. Runs corresponding to points labelled 1 through 3 employed 0.2 gram of manganese dioxide as promoter, while runs corresponding to points labeled 4 and 5 employed no promoter. In FIG. 2, the runs from which points labelled 1 through 3 were obtained employed reaction pressures of 2800, 3560 and 2900 pounds per square inch gauge, respectively, and argon pressures of 650 pounds per square inch gauge.

FIG. 1 shows the increase of hexane yield with increasing amounts of ruthenium catalyst and with either no promoter added or 0.2 gram of manganese dioxide promoter added. Similarly, FIG. 2 shows the increase of hexane yield with increasing amounts of manganese dioxide promoter and 0.1 gram of $RuCl_3 \cdot 1\text{-}3H_2O$ catalyst present. These plots indicate that, in the absence of catalyst, the promoter alone showed no water-reforming catalytic activity, with hexane yield being less than 2 mole percent of the feed. Also, for a given concentration of catalyst, addition of 0.2 gram of the promoter produced substantially increased yields of hexane in the product.

Examples 39–52 involved 2-hour batch runs in a 300-milliliter Hastelloy alloy B Magne-Dash autoclave which employed 0.1 gram of $RuCl_3 \cdot 1\text{-}3H_2O$ catalyst and 0.2 gram of various transistion metal oxides at 662°F. The argon pressure was 650 pounds per square inch gauge in each Example. The yields of hexane, carbon dioxide, and methane are shown in Table 7. There was an increase in the yield of hexane with all of the oxides used except barium oxide. There was only a small increase in the yield of hexane when copper (II) oxide was used. Thus, of the promoters shown, efficient promotion of catalytic activity in water-reforming is achieved primarily with transition metal oxides.

The ratio of the yield of methane in moles either to the yield of carbon dioxide in moles or to the yield of hexane in mole percent of the hydrocarbon feed is an indication of the relative extents to which the competing reactions of hydrocracking and in situ hydrogen formation by water-reforming proceed. The results shown in Table 7 indicate that a given promoter catalyzes hydrocracking and hydrogen production to different degrees.

TABLE 7

| Example | Promoter | Feed Composition[1] 1-Hexene | Feed Composition[1] Water | Reaction Pressure[2] | Yields Hexane[3] | Yields Carbon dioxide[4] | Yields Methane[4] |
|---|---|---|---|---|---|---|---|
| 39 | — | 17.8 | 88.8 | 2900 | 25 | 0.04 | 0.03 |
| 40 | $V_2O_5$ | 16.4 | 90.9 | — | 39 | 0.07 | 0.04 |
| 41 | $Cr_2O_3$ | 16.6 | 89.8 | 3325 | 32 | 0.07 | 0.02 |
| 42 | $MnO_2$ | 16.9 | 90.0 | 3500 | 57 | 0.05 | 0.06 |
| 43 | $Fe_2O_3$ | 15.9 | 88.7 | — | 37 | 0.09 | 0.03 |
| 44 | $TiO_2$ | 16.5 | 89.1 | — | 30 | 0.05 | 0.03 |
| 45 | $MoO_3$ | 16.4 | 89.5 | 3450 | 30 | 0.065 | 0.06 |
| 46 | CuO | 16.2 | 89.8 | — | 17 | 0.025 | — |
| 47 | BaO | 16.3 | 90.0 | 3250 | 2 | 0 | 0 |
| 48 | $ZrO_2$ | 16.4 | 90.1 | 3600 | 27 | 0.08 | 0.011 |
| 49 | $Nb_2O_5$ | 16.5 | 90.5 | 3000 | 26 | 0.068 | 0.010 |
| 50 | $Ta_2O_5$ | 12.5 | 75.8 | 3850 | 27 | 0.038 | 0.007 |
| 51 | $ReO_2$ | 16.4 | 89.2 | — | 27 | 0.01 | — |
| 52 | $WO_3$ | 17.6 | 90.6 | — | 33 | 0.053 | 0.009 |

[1]grams.
[2]pounds per square inch gauge.
[3]mole percent of hydrocarbon feed.
[4]moles.

Consequently, by choosing one promoter over another, it is possible to direct selectivity toward either hydrocracking or hydrogen production, as well as to promote the activity of the catalyst.

No theory is proposed for the mechanism by which basic metal hydroxides and carbonates and transistion metal oxides promote the activity of the catalysts in the method of this invention. However, there is evidence to indicate that the promotion of catalytic activity by transistion metal oxides at least is a chemical effect and not a surface effect. To illustrate, Example 53 was performed under the same experimental conditions as those used in Example 39, but employed instead a catalyst of 1 gram of high surface area, active carbon chips containing 5% by weight of ruthenium — that is, 0.5 millimole of ruthenium, which is equivalent to 0.1 gram of $RuCl_3 \cdot 1\text{-}3H_2O$ — with no promoter being present. The carbon chips had a surface area of 500 square meters per gram. The yield of hexane was 12 mole percent, and the yield of carbon dioxide was 0.017 mole. Both of these yields were smaller than the corresponding yields found in Example 39 in the absence of a promoter.

Examples 54–60 demonstrate the varying degrees of effectiveness of different combinations of catalysts and promoters in catalyzing cracking, hydrogenation, skeletal isomerization, and olefin-position isomerization of the hydrocarbon feed. In each case, the hydrocarbon feed was a solution of 36 mole percent of 1-hexene in the diluent benzene, except Example 58 where the benzene was replaced by ethylbenzene. In each Example, the reaction was carried out in a 300-milliliter Hastelloy alloy B Magne-Dash autoclave under an argon pressure of 650 pounds per square inch gauge at a reaction temperature of 662°F. and for a reaction time of 2 hours. The feed compositions, pressures, catalyst compositions, product yields, and conversions of the 1-hexene feed are shown in Table 8.

TABLE 8

| | Example 54 | Example 55 | Example 56 | Example 57 | Example 58 | Example 59 | Example 60 |
|---|---|---|---|---|---|---|---|
| Feed composition[1] | | | | | | | |
| Hydrocarbon | 18 | 17 | 15 | 17 | 17 | 16 | 16 |
| Water | 91 | 91 | 90 | 91 | 91 | 91 | 91 |
| Reaction pressure[2] | 2600 | 3400 | 3450 | 3550 | 3550 | 3550 | 3300 |
| Catalyst composition[1] | | | | | | | |
| $RuCl_3 \cdot 1\text{-}3H_2O$ | 0.05 | 0.05 | 0.05 | 0.05 | 0.05 | 0.05 | 0.05 |
| $Na_2CO_3$ | — | 0.3 | 0.3 | 0.6 | 0.3 | 0.3 | 0.3 |
| $TaCl_5$ | — | 0.2 | — | — | 0.2 | 0.2 | — |
| $TiO_2$ | — | — | — | — | — | — | 0.2 |
| Product Yields[3] | | | | | | | |
| Methane | 1 | 7 | 4 | 2 | 5 | 4 | 6 |
| n-pentane | 1 | 12 | 7 | 5 | 7 | 6 | 9 |
| n-hexane | 26 | 71 | 66 | 68 | 87 | 82 | 84 |
| Percent conversion of 1-hexane feed[3] | 97 | 98 | 97 | 97 | 98 | 99 | 99 |

[1]grams.
[2]pounds per square inch gauge.
[3]mole percent of 1-hexene feed.

The high conversion 1hexane in Example 54 reflects skeletal isomerization to methylpentenes and olefin-position isomerization to 2-and 3-hexene, but there was only a 26% yield of hexane with the unpromoted catalyst system. Addition of a transistion metal oxide, a transiton metal salt — for example tantalum pentachloride — which formed a transistion metal oxide under the conditions employed, or a basic metal carbonate caused a substantial increase in the yield of hexane. When the catalyst system was basic, skeletal isomerization was completely suppressed, but olefin-position isomerization still occurred. None of the catalyst systems in Examples 54–60 were effective in cracking or hydrogenating the diluents, benzene and ethylbenzene. When ethylbenzene was used as the diluent, only trace amounts of dealkylated products, benzene and toluene, were produced.

Examples 61–67 demonstrate the relatively high efficiency of certain members of the catalyst system of the method of this invention in catalyzing the cracking of alkyl aromatics. In each Example, the hydrocarbon feed was a solution of 43 mole percent of 1-hexene and 57 mole percent of ethylbenzene. In each Example, the hydrocarbon and water were contacted for 2 hours in a 300-milliliter Hastelloy alloy B Magne-Dash autoclave at a reaction temperature of 662°F. and under an argon pressure of 650 pounds per square inch gauge. The feed compositions, reaction pressures, catalyst compositions and product yields are shown in Table 9.

Although all the catalyst systems employed in Examples 61–67 were effective in catalyzing water-reforming activity involving 1-hexene, only iridium and rhodium were effective in cleaving ethylbenzene to benzene and toluene. Comparison of the product yields in Examples 64–66 indicates that cleavage of alkyl aromatics is effected using a catalyst system involving the combination of either iridium or rhodium with another one of the catalysts of this invention, but not iridium or rhodium alone.

TABLE 9

| | Example 61 | Example 62 | Example 63 | Example 64 | Example 65 | Example 66 | Example 67 |
|---|---|---|---|---|---|---|---|
| Feed composition[1] | | | | | | | |
| Hydrocarbon | 17 | 17 | 18 | 17 | 16 | 16 | 16 |
| Water | 89 | 91 | 90 | 90 | 91 | 90 | 90 |
| Reaction pressure[2] | 3200 | 3050 | 2900 | 2900 | 2650 | 2550 | 2550 |
| Catalyst composition[1] | | | | | | | |
| $RuCl_3.1\text{-}3H_2O$ | — | 0.05 | 0.05 | 0.05 | 0.05 | 0.05 | 0.05 |
| $Na_2CO_3$ | 0.3 | 0.3 | 0.3 | 0.3 | 0.3 | 0.3 | 0.3 |
| $H_2PtCl_3$ | — | 0.1 | — | — | — | — | — |
| $CoCl_3$ | — | — | — | — | — | — | 0.1 |
| $IrCl_3.3H_2O$ | 0.05 | — | — | 0.1 | 0.2 | — | — |
| $RnCl_3.3H_2O$ | — | — | — | — | — | 0.10 | — |
| $PdCl_2$ | — | — | 0.1 | — | — | — | — |
| Yield | | | | | | | |
| Hexane[3] | 20 | 68 | 47 | 85 | 85 | 88 | 58 |
| Benzene[4] | 1 | 2 | 1 | 4 | 3 | 3 | 1 |
| Toluene[4] | 1 | 1 | 2 | 14 | 8 | 4 | 1 |

[1]grams.
[2]pounds per square inch gauge.
[3]produced from 1-hexene and reported as mole percent of 1-hexene feed.
[4]produced from ethylbenzene and reported as mole percent of alkylbenzene feed.

Examples 68–70 demonstrate that alkylbenzenes are cleaved using the method of this invention with the same catalyst system used in Example 64, even in the absence of an olefin in the hydrocarbon feed. Each of these Examples involve 2-hour runs in a 300-milliliter Hastelloy alloy B Magne-Dash reactor, at a reaction temperature of 662°F. and under an argon pressure of 650 pounds per square inch gauge. The hydrocarbon feed compositions, the amounts of water added, the reaction pressures, and the yields of products from the cracking of the alkyl aromatics are shown in Table 10.

Example 71 demonstrates that saturated hydrocarbons can be cracked in the method of this invention using the same catalyst system used in Example 64. In this Example, 15.9 grams of n-heptane and 92.4 grams of water were mixed in a 300-milliliter Hastelloy alloy B Magne-Dash autoclave and heated at a reaction temperature of 662°F. under a reaction pressure of 3100 pounds per square inch gauge and an argon pressure of 650 pounds per square inch gauge for a reaction time of 2 hours. Methane in the amount of 0.67 grams — corresponding to 4.2 weight percent of the n-heptane feed — was produced in the reaction. The fact that only traces of products having a higher carbon number than methane were found indicates that, when a molecule of saturated hydrocarbon cracks, it cracks to completion.

Examples 72–101 involve processing of tar sands oil feeds in a 300-milliliter Hastelloy alloy C Magne-Drive reactor. The properties of the tar sands feeds employed in these Examples are shown in Table 5. Topped tar sands oil is the straight tar sands oil whose properties are presented in Table 5 but from which approximately 25 weight percent of light material has been removed. Straight tar sands oil was used as feed in Examples 72–87, while topped tar sands oil was used as feed in Examples 88–101. The experimental conditions used and the results of analyses of the products obtained in these Examples are shown in Tables 11 and 12, respectively.

TABLE 10

| | Example 68 | Example 69 | Example 70 |
|---|---|---|---|
| Feed composition[1] | | | |
| ethylbenzene | 0.15 | — | — |
| propylbenzene | — | 0.050 | — |
| toluene | — | — | 0.16 |
| n-heptane | — | 0.12 | — |
| water[2] | 91 | 91 | 92 |
| Reaction pressure[3] | 2450 | 3000 | 2900 |
| Product composition[1] | | | |
| methane | 0.05 | 0.05 | 0.008 |
| benzene | 0.001(1%)[4] | 0.001(2%)[4] | 0.005(3%)[4] |
| toluene | 0.018(12%)[4] | 0.007(14%)[4] | 0.15 |
| ethylbenzene[5] | 0.13 | 0.004(8%)[4] | 0.001(0.6%)[4] |
| propylbenzene | — | 0.039 | — |

[1]moles except where otherwise indicated.
[2]grams.
[3]pounds per square inch gauge.
[4]mole percent of the alkyl aromatic feed in parenthesis.
[5]including xylenes.

TABLE 11

| Example | Reaction Time[1] | Reaction Pressure[2] | Argon Pressure[2] | Amount of Water Added[3] | Oil-to-Water Weight Ratio | Catalyst | Amount of Catalyst Added[4] |
|---|---|---|---|---|---|---|---|
| 72 | 6 | 4550 | 450 | 91 | 1:3 | Rh + Os | .15 + .14 |
| 73 | 6 | 4650 | 450 | 90 | 1:3 | Ru | .15 |
| 74 | 2 | 4600 | 450 | 90 | 1:3 | Ru | .15 |
| 75 | 6 | 4400 | 450 | 90 | 1:3 | — | — |
| 76 | 3 | 4350 | 400 | 90 | 1:3 | — | — |
| 77 | 1 | 4350 | 400 | 90 | 1:3 | — | — |
| 78 | 3 | 4350 | 400 | 90 | 1:3 | Rh + Os | .15 + .14 |
| 79 | 1 | 4500 | 400 | 91 | 1:3 | Rh + Os | .15 + .14 |
| 80 | 1 | 4425 | 400 | 90 | 1:3 | Ru + Os | .15 + .14 |
| 81 | 2 | 4100 | 400 | 90 | 1:3 | $Fe_2O_3$ + $KMnO_4$ | .10 + .10 |
| 82 | 1 | 4250 | 400 | 80 | 1:2 | Ru + Os | .15 + .20 |
| 83 | 1 | 4250 | 400 | 80 | 1:2 | Rh + Os | .15 + .20 |
| 84 | 1 | 4350 | 400 | 90 | 1:3 | $FeCl_3$ + $MnO_2$ | .10 + .05 |
| 85 | 2 | 4200 | 400 | 80 | 1:3 | NaOH | .04 |
| 86 | 2 | 4200 | 400 | 80 | 1:3 | Ru + NaOH | .15 + .04 |
| 87 | 1 | 4300 | 400 | 91 | 1:3 | $MnO_2$ | .30 |
| 88 | 1 | 4300 | 400 | 90 | 1:3 | — | — |
| 89 | 3 | 4300 | 400 | 90 | 1:3 | — | — |
| 90 | 3 | 4300 | 400 | 90 | 1:3 | Rh + Os | .15 + .14 |
| 91 | 1 | 4350 | 400 | 90 | 1:3 | Rh + Os | .15 + .14 |
| 92 | 1 | 4450 | 400 | 90 | 1:3 | Ru + Os | .15 + .14 |
| 93 | 2 | 4150 | 400 | 80 | 3:8 | Ru | .15 |
| 94 | 2 | 4250 | 400 | 90 | 1:3 | $FeCl_3$ + $KMnO_4$ | .10 + .10 |
| 95 | 1 | 4100 | 400 | 80 | 1:2 | Rh + Os | .15 + .20 |
| 96 | 1 | 4225 | 400 | 80 | 1:2 | Ru + Os | .15 + .20 |
| 97 | 1 | 4100 | 400 | 90 | 1:3 | $FeCl_3$ + $MnO_2$ | .10 + .05 |
| 98 | 1 | 4300 | 400 | 90 | 1:3 | Ru + $MnO_2$ | .15 + .05 |
| 99 | 1 | 4300 | 400 | 90 | 1:3 | Ru + $MnO_2$ | .15 + .30 |
| 100 | 2 | 4350 | 400 | 80 | 1:3 | NaOH | .04 |
| 101 | 1 | 4250 | 400 | 90 | 1:3 | $MnO_2$ | .30 |

[1]hours.
[2]pounds per square inch gauge.
[3]grams.
[4]The amounts of catalysts added are presented in grams and in the same order in which the corresponding catalysts are listed.

TABLE 12

| | Product Composition[1] | | | | Percent Removal of[2] | | | | | |
|---|---|---|---|---|---|---|---|---|---|---|
| Example | Gas | Light Ends | Heavy Ends | Solids | Sulfur | Nickel | Vanadium | H-C[3] | API Gravity[4] | Weight Balance[5] |
| 72 | 8.6 | 77.7 | 5.2 | 7.8 | 48 | — | — | — | — | 100.7 |
| 73 | 3.3 | 70.2 | 6.0 | 13.8 | 48 | — | — | — | — | 101.2 |
| 74 | 2.3 | 76.7 | 12.7 | 8.5 | 48 | — | — | — | — | 99.6 |
| 75 | 3.7 | 84.2 | 5.7 | 6.4 | 56 | — | — | — | — | 97.2 |
| 76 | 11.2 | 75.2 | 8.6 | 5.0 | 63 | 95 | 74 | 1.451 | 20.5 | 100.2 |
| 77 | 1.3 | 70.6 | 27.1 | 1.0 | 36 | 69 | 77 | 1.362 | 20.5 | 99.4 |
| 78 | 12.1 | 72.0 | 8.3 | 7.7 | 35 | 97 | 84 | 1.441 | 22.7 | 100.8 |
| 79 | 0.3 | 75.2 | 16.8 | 5.4 | 52 | — | 86 | 1.513 | — | 99.7 |
| 80 | 2.7 | 71.6 | 21.1 | 5.3 | 33 | 28 | 64 | 1.408 | 20.8 | 99.7 |
| 81 | 4.1 | 68.3 | 23.9 | 5.1 | 25 | 94 | 86 | — | 14.0 | 99.1 |
| 82 | 1.7 | 66.4 | 28.9 | 3.3 | — | — | — | — | — | 99.8 |
| 83 | 4.3 | 60.5 | 32.3 | 3.0 | 71 | 78 | 74 | — | 20.7 | 101.2 |
| 84 | 5.0 | 66.0 | 27.8 | 1.0 | 33 | 19 | 70 | — | — | 100.4 |
| 85 | 2.7 | 72.1 | 23.0 | 2.2 | 74 | 85 | 82 | — | — | 99.7 |
| 86 | 8.0 | 68.9 | 14.7 | 8.5 | 77 | 89 | 84 | — | — | 100.6 |
| 87 | 7.7 | 68.6 | 22.4 | 1.3 | 80 | 80 | 96 | — | — | 99.8 |
| 88 | 1.0 | 62.9 | 39.4 | 0.1 | 39 | 42 | 75 | — | — | 99.9 |
| 89 | 5.9 | 67.2 | 20.0 | 6.9 | 49 | 77 | 96 | 1.418 | 12.5 | 99.7 |
| 90 | 16.0 | 63.0 | 12.0 | 9.0 | 42 | 88 | 83 | 1.442 | 18.9 | 100.9 |
| 91 | 3.6 | 54.9 | 31.7 | 3.2 | 37 | 82 | 88 | 1.481 | 12.5 | 100.2 |
| 92 | 1.0 | 67.8 | 25.0 | 7.4 | 59 | 79 | 92 | 1.435 | 12.1 | 99.6 |
| 93 | 3.1 | 62.0 | 26.8 | 7.4 | 81 | 8 | 88 | — | 12.2 | 99.3 |
| 94 | 8.1 | 61.7 | 30.0 | 5.9 | 28 | 98 | 76 | — | 10.0 | 100.3 |
| 95 | 5.0 | 48.5 | 43.1 | 3.4 | — | — | — | — | — | 100.0 |
| 96 | 4.7 | 55.0 | 35.2 | 5.1 | 33 | 77 | 77 | — | 14.4 | 100.1 |
| 97 | 5.5 | 52.0 | 41.8 | 0.7 | 81 | 17 | 91 | — | — | 100.2 |
| 98 | 6.7 | 56.4 | 31.5 | 5.4 | 82 | 94 | 95 | — | — | 100.0 |
| 99 | 5.7 | 59.2 | 32.4 | 2.7 | 82 | 93 | 91 | — | — | 99.9 |
| 100 | 5.0 | 59.9 | 32.2 | 2.9 | 37 | 91 | 92 | — | — | 100.0 |
| 101 | 5.7 | 59.8 | 33.2 | 1.3 | 80 | 86 | 93 | — | — | 100.3 |

[1]weight percent of hydrocarbon feed.
[2]These values were obtained from analyses of the combined light and heavy ends.
[3]atom ratio of hydrogen-to-carbon.
[4]°API.
[5]Total weight percent of hydrocarbon and water feeds and catalyst recovered as product and water.

The reaction temperature was 752°F. in each Example. Ruthenium, rhodium, and osmium was added in the form of soluble $RuCl_3 \cdot 1\text{-}3H_2O$, $RhCl_3 \cdot 3H_2O$, and $OsCl_3 \cdot 3H_2O$, respectively. Each component of the catalyst system in each Example was added either in the form of its aqueous solution or as the solid in a solid-water slurry, depending on whether or not the component was water-soluble.

Comparison of the results shown in Table 12 shows that the production of gas and solid residue and the extent of removal of sulfur and metals increased when the reaction time increased from 1 to 3 hours, when no catalyst was added from an external source. Addition of a catalyst from an external source produced small increases in the yield of solid residues and in the API gravities of the liquid product, but, unlike with feeds other than tar sands oils, had little effect on yields from hydrocracking and on C/H atom ratios. Further, alteration of the oil-to-water weight ratio from 1:3 to 1:2 generally resulted in a decrease in the extent of removal of sulfur and metals and an adverse shift in the product distribution. With feeds other than tar sands oil, the shifts were less adverse with increases in the hydrocarbon-to-water weight ratio, until 1:1 was reached.

The results for the heavier topped tar sands oil are similar to those for the straight tar sands oil. One difference is that the conversion of heavy ends to light ends for the topped tar sands oil continued to increase as the reaction time increased from 1 to 3 hours, while such conversion was substantially complete in about one hour for the straight tar sands oil.

The total yields and compositions of the gas products obtained in a number of the Examples whose results are shown in Table 12 are indicated in Table 13. In all cases, the main component of the gas products was argon which was used in pressurization of the reactor and which is not reported in Table 13.

TABLE 13

| Example | Presence of Externally Added Catalyst | Reaction Time | Oil-to-water weight Ratio | Composition[2] of the Gas Products $H_2$ | $CO_2$ | $CH_4$ | Weight Percent Gas Products |
|---|---|---|---|---|---|---|---|
| 77 | No | 1 | 1:3 | 2.8 | 3.1 | 3.4 | 1.3 |
| 76 | No | 3 | 1:3 | 3.3 | 5.2 | 6.9 | 11.2 |
| 78 | Yes | 3 | 1:3 | — | 5.2 | 8.1 | 12.1 |
| 83 | Yes | 1 | 1:2 | 5.1 | 4.5 | 5.8 | 4.3 |
| 88 | No | 1 | 1:3 | 1.0 | 3.8 | 8.4 | 1.0 |
| 89 | No | 3 | 1:3 | 3.0 | 5.6 | 7.5 | 5.9 |
| 91 | Yes | 1 | 1:3 | 3.7 | 3.0 | 4.2 | 3.6 |
| 90 | Yes | 3 | 1:3 | 4.5 | 7.1 | 8.4 | 16.0 |

[1]hours
[2]mole percent of gas products

Changing the oil-to-water weight ratio from 1:3 to 1:2 and/or increasing the reaction time resulted in increased yields of gas. Addition of a catalyst also caused an increase in the yield of gaseous products.

The presence of carbon dioxide and hydrogen among the gas products obtained in Examples 76, 77, 88, and 89 suggests that hydrogen and carbon monoxide were generated even without the addition of catalysts from an external source, probably with metals inherently present in the tar sands oils serving as catalysts.

Comparison of the results shown in Table 12 indicates that addition of catalysts generally resulted in a greater degree of desulfurization that that caused when no catalyst was added from an external source. Further, addition of a transition metal oxide or a basic metal hydroxide or carbonate either alone or as a promoter in the presence of a water-reforming catalyst markedly improved the degree of desulfurization. However, as with hydrocarbon feeds other than tar sands oils, the extent of desulfurization decreased with increasing reaction time.

Comparison of the results shown in Table 12 indicates that there was substantial removal of metals even after a reaction time of less than 1 hour and even in the absence of a catalyst added from an external source. However, addition of a catalyst and/or a transition metal oxide or a basic metal hydroxide or carbonate promoter further increased the extent of demetalation.

Examples 102–155 involve batch runs in a 300-milliliter Hastelloy alloy C Magne-Drive reactor using Khafji and C atmospheric residual oils. The properties of these residual oils are shown in Table 5 and are designated by the letter B. Examples 102–119 involve Khafji atmospheric residual oil, while Examples 120–155 involve C atmospheric residual oil. The reaction conditions employed in these Examples is indicated in Table 14. All runs were made at 725°F., except where otherwise indicated in Table 14. The experimental results are indicated in Table 15.

TABLE 14

| Example | Reaction Time[1] | Reaction Pressure[2] | Argon Pressure[2] | Oil-to-Water Weight Ratio | Amount of Water Added[3] | Catalyst | Amount of Added Catalyst[8] |
|---|---|---|---|---|---|---|---|
| 102 | 13[9] | 3600 | 400 | 1:3.2 | 96 | Os[4] | 0.2 |
| 103 | 8[9] | 3650 | 400 | 1:3.2 | 96 | Ru[5] | 0.12 |
| 104 | 2[9] | 4550 | 450 | 1:3 | 90 | Rh[6], Os | 0.12, 0.17 |
| 105 | 6[9] | 3600 | 450 | 1:3 | 90 | — | — |
| 106 | 6[9] | 3600 | 450 | 1:3 | 90 | — | — |
| 107 | 6[9] | 2500 | 450 | 4:1 | 30 | — | — |
| 108 | 6 | 4450 | 450 | 1:3 | 90 | Rh, Os | 0.15, 0.14 |
| 109 | 4 | 4500 | 450 | 1:3 | 90 | Rh, Os | 0.15, 0.14 |
| 110 | 1 | 4400 | 400 | 1:3 | 90 | Ru, Os | 0.15, 0.14 |
| 111 | 1 | 4300 | 400 | 1:3 | 90 | Ru, Os | 0.3, 0.4 |
| 112 | 1 | 4150 | 400 | 1:3 | 90 | $FeCl_3$, $MnO_2$ | 0.1, 0.05 |
| 113 | 1 | 4150 | 400 | 1:2 | 80 | $FeCl_3$, $MnO_2$ | 0.1, 0.05 |
| 114 | 1 | 4150 | 400 | 1:3 | 90 | Ru, $Cr_2O_3$ | 0.15, 0.09 |
| 115 | 1 | 4300 | 400 | 1:3 | 90 | Ru, Os, $Cr_2O_3$ | 0.15, 0.2, 0.09 |
| 116 | 1 | 4100 | 400 | 1:2 | 80 | Ru, Os | 0.15, 0.2 |
| 117 | 1 | 4000 | 400 | 1:1 | 60 | Ru, Os | 0.15, 0.2 |
| 118 | 1 | 4250 | 400 | 1:2 | 80 | Ru, Os | 0.15, 0.2 |
| 119 | 1 | 4150 | 400 | 1:1 | 60 | Ru, Os | 0.15, 0.2 |
| 120 | 1 | 4300 | 400 | 1:3 | 90 | Ru, $MnO_2$ | 0.15, 0.6 |
| 121 | 2 | 4300 | 400 | 1:3.75 | 80 | Ru, NaOH | 0.15, 10 |

TABLE 14-continued

| Example | Reaction Time[1] | Reaction Pressure[2] | Argon Pressure[2] | Oil-to-Water Weight Ratio | Amount of Water Added[3] | Catalyst | Amount of Added Catalyst[8] |
|---|---|---|---|---|---|---|---|
| 122 | 1 | 4250 | 400 | 1:3 | 90 | Ru, Os, $Cr_2O_3$ | 0.15, 0.2, 0.09 |
| 123 | 1 | 4225 | 400 | 1:3 | 90 | Rh, Os | 0.15, 0.2 |
| 124 | 1 | 4200 | 400 | 1:3 | 90 | Rh, Os | 0.15, 0.2 |
| 125 | 1 | 4250 | 400 | 1:3 | 90 | Rh, Os | 0.15, 0.2 |
| 126 | 1 | 4100 | 400 | 1:1 | 60 | Ru, Os | 0.15, 0.2 |
| 127 | 1 | 4600 | 400 | 1:2 | 80 | Ru, Os, $H_2WO_4$ | 0.15, 0.2, 0.3 |
| 128 | 1 | 4400 | 400 | 1:2 | 80 | Ru, Os $TiO_2$ | 0.15, 0.2, 0.3 |
| 129 | 1 | 4450 | 400 | 1:3 | 90 | KOH | 0.5 |
| 130 | 1 | 4550 | 400 | 1:3 | 90 | KOH | 1 |
| 131 | 2 | 4200 | 400 | 1:3 | 90 | Ru, $Na_2CO_3$ | 0.15, 0.3 |
| 132 | 2 | 4400 | 400 | 1:3 | 90 | Ru, $TaCl_5$, $Na_2CO_3$ | 0.15, 0.2, 0.3 |
| 133 | 2 | 4400 | 400 | 1:3 | 90[10] | Ru, $Na_2CO_3$ | 0.15, 0.3 |
| 134 | 18[11] | 3900 | 500 | 1:3 | 90 | Ru | 0.12 |
| 135 | 16[12] | 3775 | 450 | 1:3.2 | 96 | Os | 0.2 |
| 136 | 16[12] | 3650 | 500 | 1:3.2 | 96 | Ru | 0.2 |
| 137 | 6[12] | 3700 | | 1:3.2 | 96 | Rh, Os | 0.12, 0.22 |
| 138 | 2 | 4550 | 450 | 1:3 | 90 | Rh, Os | 0.12, 0.17 |
| 139 | 6[12] | 2600 | 450 | 4:1 | 30 | — | — |
| 140 | 6[12] | 3600 | 450 | 1:3 | 90 | — | — |
| 141 | 6 | 4550 | 450 | 1:3 | 90 | Rh, Os | 0.15, 0.14 |
| 142 | 4 | 4450 | 450 | 1:3 | 91 | Rh, Os | 0.15, 0.14 |
| 143 | 2 | 4300 | 400 | 1:2 | 80 | Rh, Os | 0.15, 0.14 |
| 144 | 1 | 4275 | 400 | 1:2 | 80 | Rh, Os | 0.15, 0.14 |
| 145 | 0.5 | 4450 | 400 | 1:3 | 90 | Rh, Os | 0.15, 0.14 |
| 146 | 0.5 | 4375 | 400 | 1:3 | 90 | Rh, Os | 0.15, 0.14 |
| 147 | 1 | 4400 | 400 | 1:3 | — | Ru, Os | 0.3, 0.4 |
| 148 | 2 | 4400 | 400 | 1:3 | — | Ru, Os | 0.3, 0.4 |
| 149 | 1 | 4400 | 400 | 1:3 | — | Ru, Os | 0.3, 0.4 |
| 150 | 1 | 4200 | 400 | 1:3 | — | $FeCl_3$, $MnO_2$ | 0.1, 0.05 |
| 151 | 1 | 4200 | 400 | 1:2 | 80 | $FeCl_3$, $MnO_2$ | 0.1, 0.05 |
| 152 | 1 | 4300 | 400 | 1:3 | 90 | Ru, $Cr_2O_3$ | 0.15, 0.09 |
| 153 | 1 | 4150 | 400 | 1:3 | 90 | Ru, $MnO_2$ | 0.15, 0.05 |
| 154 | 1 | 4200 | 400 | 1:3 | 90 | Ru, $MnO_2$ | 0.15, 0.3 |
| 155 | 2 | 4250 | 300 | 1:3 | 90 | Ru, Ir[7] | 0.10, 0.10 |

[1]hours.
[2]pounds per square inch gauge.
[3]grams.
[4]added as $OsCl_3.H_2O$.
[5]added as $RuCl_3.1-3H_2O$.
[6]added as $RhCl_3.3H_2O$.
[7]added as $IrCl_3.3H_2O$.
[8]The amounts of catalysts added are presented in grams and in the same order in which the corresponding catalysts are listed.
[9]The reaction temperature was 716°F.
[10]The water also contained 5 grams of 1-hexene as an additional source of hydrogen.
[11]The reaction temperature was 698°F.
[12]The reaction temperature was 710°F.

TABLE 15

| Example | Product Composition[1] | | | | Percent Removal of[2] | | | Mass Balance[3] |
|---|---|---|---|---|---|---|---|---|
| | Gas | Light Ends | Heavy Ends | Solids | Sulfur | Vanadium | Nickel | |
| 102 | 9.9 | 1.7 | 82.2 | 6.2 | 37 | — | — | 99.3 |
| 103 | 9.6 | 0 | 83.2 | 9.3 | 38 | — | — | 99.6 |
| 104 | 5.0 | 57.3 | 37.0 | 0.7 | 14 | — | — | 98.4 |
| 105 | 3.9 | 88.8[2] | | 0 | — | — | — | 92.7 |
| 106 | 4.0 | 49.2 | 45.0 | 1.8 | 35 | — | — | 102.3 |
| 107 | 2.5 | 37.4 | 60.8 | 0.3 | 22 | — | — | 97.1 |
| 108 | 7.1 | 69.9 | 13.2 | 9.8 | 22 | — | — | 103.6 |
| 109 | 6.8 | 66.2 | 15.3 | 11.7 | — | — | — | 98.3 |
| 110[4] | 2.0 | 60.7 | 38.3 | 4.8 | 50 | 84 | — | 101.2 |
| 111[5] | 0 | 58.2 | 32.0 | 10.8 | 69 | 98 | — | 101.9 |
| 112 | 0 | 56.6 | 43.5 | 2.0 | 82 | 98 | — | 100.4 |
| 113 | 0 | 57.2 | 43.4 | 1.3 | 72 | 98 | — | 100.5 |
| 114 | 7.3 | 42.7 | 47.1 | 2.7 | 78 | 98 | — | 100.0 |
| 115 | 6.7 | 51.6 | 37.5 | 4.2 | 61 | 80 | 26 | 100.1 |
| 116 | 2.4 | 47.0 | 48.0 | 2.6 | 72 | 98 | 52 | 99.2 |
| 117 | 1.5 | 52.6 | 44.0 | 2.6 | — | — | — | 98.9 |
| 118 | 4.5 | 52.2 | 41.1 | 2.3 | 26 | 98 | 81 | 99.7 |
| 119 | 2.2 | 45.5 | 50.0 | 2.5 | 13 | 84 | 74 | 99.3 |
| 120 | 4.0 | 54.9 | 37.6 | 3.5 | 72 | 72 | 75 | 99.5 |
| 121 | 3.3 | 66.8 | 29.8 | 6.1 | 27 | 92 | 88 | 100.4 |
| 122 | 6.7 | 57.3 | 35.3 | 4.3 | 24 | 76 | 81 | 100.5 |
| 123 | 7.0 | 58.9 | 39.1 | 2.2 | — | — | — | 101.1 |
| 124 | 2.9 | 50.5 | 43.2 | 3.4 | 77 | 76 | — | 99.3 |
| 125 | 3.3 | 56.9 | 38.1 | 1.7 | 23 | 76 | 62 | 100.2 |
| 126 | 2.8 | 53.1 | 42.3 | 1.8 | 23 | 92 | 38 | 99.8 |
| 127 | 2.0 | 68.3 | 26.4 | 3.4 | — | 92 | 56 | 99.6 |
| 128 | 3.3 | 61.3 | 31.8 | 3.9 | — | 92 | 88 | 100.4 |
| 129 | 1.3 | 54.3 | 36.9 | 7.5 | 79 | 92 | — | 100.6 |
| 130 | 2.0 | 51.7 | 39.7 | 6.7 | 82 | 90 | — | 101.1 |

TABLE 15-continued

| Example | Product Composition[1] Gas | Light Ends | Heavy Ends | Solids | Percent Removal of[2] Sulfur | Vanadium | Nickel | Mass Balance[3] |
|---|---|---|---|---|---|---|---|---|
| 131 | 2.7 | 48.0 | 43.3 | 9.5 | — | — | — | 102.7 |
| 132 | 3.6 | 62.0 | 31.2 | 5.2 | — | — | — | 100.4 |
| 133 | 4.3 | 60.6 | 30.2 | 4.9 | — | — | — | 98.0 |
| 134 | 6.3 | 36.6 | 48.0 | 6.1 | 47 | — | — | 96.6 |
| 135 | 22.0 | 17.0 | 60.0 | 10.2 | 42 | — | — | 91.5 |
| 136 | 12.0 | 8.0 | 71.1 | 10.0 | 30 | — | — | 91.8 |
| 137 | 4.5 | 56.8 | 38.6 | 5.3 | 30 | — | — | 101.3 |
| 138 | 6.3 | 66.8 | 26.7 | 4 | 23 | — | — | 103.8 |
| 139 | 2.5 | 35.3 | 62.1 | 0.7 | 30 | — | — | 98.4 |
| 140 | 4.7 | 53.0 | 38.0 | 1.3 | 32 | — | — | 100.7 |
| 141 | 4.3 | 70.5 | 14.6 | 10 | 92 | — | — | 99.7 |
| 142 | 6.3 | 58.5 | 21.0 | 7.2 | 51 | — | — | 100.0 |
| 143 | 4.4 | 67.8 | 25.0 | 7.4 | 22 | 92 | — | 100.2 |
| 144 | 2.0 | 55.0 | 43.3 | 1.9 | 26 | 84 | — | 100.2 |
| 145 | 2.0 | 54.7 | 40.8 | 2.3 | 67 | 92 | — | 102.5 |
| 146 | 0.7 | 61.7 | 41.3 | 1.2 | 80 | 56 | — | 101.3 |
| 147 | 1.7 | 61.8 | 33.5 | 2.4 | 66 | 92 | — | 99.9 |
| 148 | 2.2 | 70.5 | 25.7 | 3.9 | 24 | 80 | — | 100.0 |
| 149[6] | 0.3 | 64.0 | 33.3 | 5.7 | 68 | 98 | — | 100.3 |
| 150 | 0 | 53.4 | 49.5 | 0.6 | 77 | 98 | — | 99.9 |
| 151 | 0.7 | 54.9 | 42.8 | 1.5 | 65 | 98 | — | 99.9 |
| 152 | 9.1 | 45.3 | 44.6 | 2.5 | 79 | 98 | — | 101.1 |
| 153 | 6.0 | 47.5 | 44.6 | 1.9 | 80 | 98 | — | 101.1 |
| 154 | 0.3 | 56.0 | 41.0 | 2.7 | 79 | 98 | — | 99.9 |
| 155 | 7.0 | 56.0 | 31.0 | 6.0 | — | — | — | 100.2 |

[1]weight percent of the hydrocarbon feed.
[2]These values were obtained from analyses of the combined light and heavy ends.
[3]Total weight percent of hydrocarbon and water feed and catalyst recovered as product and water.
[4]The combined light ends and heavy ends fractions had a H/C atom ratio of 1.524.
[5]The combined light ends and heavy ends fractions had a H/C atom ratio of 1.644.
[6]The combined light ends and heavy ends fractions had a H/C atom ratio of 1.7.

The results in Table 15 indicate that cracking and desulfurization occurred in runs made in the absence of a catalyst added from an external source as well as in runs made with an added catalyst. However, addition of a catalyst from an external source significantly enhanced the yields of gases and of light ends, even after a greatly reduced reaction time. Further, addition of a promoter to the catalyst system caused an increase both in the absolute yield of gases and in the ratio of yields of gas-to-solid. Use of sufficient water to maintain a water density of at least 0.1 gram per milliliter — that is, use of hydrocarbon feed and water in proportions such that the weight ratio of water-to-hydrocarbon feed was relatively high — also caused a greater yield of gases and light ends, and a greater extent of desulfurization than when the weight ratio of water-to-hydrocarbon was relatively low. Addition of 1-hexene, a hydrogen donor, to the reaction mixture resulted in a lower yield of solid product and an increased yield of light ends.

In general, the extent of desulfurization increased when the reaction temperature was higher, when the reaction time was in a certain range, when the water-to-hydrocarbon feed weight ratio was higher, and when a promoter was added to the catalyst system. Further, use of the promoters even in the absence of a catalyst caused satisfactory desulfurization.

In general, the extent of demetalation increased when the water-to-hydrocarbon feed weight ratio was higher, when a promoter was added to the catalyst system and when the reaction time was in a certain range. Further, use of the promoters even in the absence of a catalyst caused satisfactory demetalation.

Examples 156–172 involve batch runs in a 300-milliliter Hastelloy alloy C Magne-Drive autoclave using C vacuum residual oil and Cyrus atmospheric residual oil. The properties of these residual oils are shown in Table 5 and are designated by the letter B. Examples 156–158 involve C vacuum residual oil, while Examples 159–172 involve Cyrus atmospheric residual oil. The reaction conditions employed in these Examples are indicated in Table 16. All runs were made at 752°F. The experimental results are indicated in Table 17.

The results in Table 17 indicate that satisfactory desulfurization and demetalation of C vacuum and Cyrus atmospheric residual oils were effected. Cracking of the C vacuum residual oil resulted in some formation of gases and light ends but not to the extent found with tar sands oil and with Khafji and C atmospheric residual oils.

Cracking of the Cyrus atmospheric residual oil occurred more readily than cracking of C vacuum residual oil, but the Cyrus atmospheric residual oil appeared to be more refractory than the Khafji or C atmospheric residual oils. Cracking of the Cyrus atmospheric residual oil in the absence of a catalyst added from an external source resulted in a large yield of solid products. Cracking of this hydrocarbon feed in the presence of a ruthenium catalyst or rhodium -osmium combination catalyst added from an external source results in an increase in the yield of light ends but did not lower the yield of solid product. However, cracking of this hydrocarbon feed in the presence of an iron-manganese or ruthenium-osmium combination catalyst or with a hydrogen-donor, like ethanol or 1-hexene, added to the water solvent resulted in a lower yield of solid product and an increased yield of light ends.

Example 173 illustrates the denitrification of hydrocarbons by the method of this invention and involves a 2-hour batch run in a 300-milliliter Hastelloy alloy B Magne-Dash autoclave. In this Example 15.7 grams of 1-hexene were processed with 91.4 grams of water containing 1 milliliter (0.97 grams ) of pyrrole, in the presence of 0.1 gram of soluble $RuCl_3 \cdot 1\text{-}3H_2O$ catalyst, at a reaction temperature of 662°F., and under a reaction pressure of 3380 pounds per square inch gauge and an argon pressure of 650 pounds per square inch gauge.

TABLE 16

| Example | Reaction Time[1] | Reaction Pressure[2] | Argon Pressure[2] | Oil-to-Water Weight Ratio | Amount of Water Added[3] | Catalyst | Amount of Added Catalyst[7] |
|---|---|---|---|---|---|---|---|
| 156 | 1 | 4250 | 400 | 1:3 | 90 | Ru[4],Os[5],$Cr_2O_3$ | .15, .2, .09 |
| 157 | 2 | 4250 | 400 | 1:3 | 90 | Ru,Os,$Cr_2O_3$ | .15, .2, .09 |
| 158 | 1 | 4150 | 400 | 1:3 | 90 | KOH | 1 |
| 159 | 2 | 4550 | 450 | 1:3 | 92 | Ru | .12 |
| 160 | 2 | 4400 | 450 | 1:3 | 90 | — | |
| 161 | 2 | 4450 | 450 | 1:3 | 91 | Rh[6] + Os | .15, .14 |
| 162 | 2 | 4300 | 400 | 1:2.3 | 70[8] | Rh, Os | .15, .14 |
| 163 | 2 | 4100 | 400 | 1:2.3 | 70[8] | Rh, Os | .15, .14 |
| 164 | 2 | 3550 | 400 | 1:2.3 | 71[8] | Ru | .12 |
| 165 | 4 | 4400 | 400 | 1:2.3 | 70[9] | Ru | .12 |
| 166 | 2 | 4350 | 400 | 1:2.3 | 61[10] | Ru | .12 |
| 167 | 2 | 4350 | 350 | 1:2.3 | 61[11] | Ru | .12 |
| 168 | 2 | 4250 | 400 | 1:3 | 90 | Ru + Os | .12, .14 |
| 169 | 1 | 4350 | 400 | 1:3 | 90 | Ru + Os | .12, .14 |
| 170 | 1 | 4400 | 400 | 1:3 | 90 | Ru + Os | .3, .4 |
| 171 | 1 | 4200 | 400 | 1:3 | 90 | $FeCl_3$ + $MnO_2$ | .1, .05 |
| 172 | 1 | 4150 | 400 | 1:2 | 80 | $FeCl_3$ + $MnO_2$ | .1, .05 |

[1]hours.
[2]pounds per square inch gauge.
[3]grams.
[4]added as $RuCl_3.1-3\ H_2O$
[5]added as $RhCl_3.3\ H_2O$
[6]added as $RhCl_3.3\ H_2O$
7The amounts of catalysts added are presented in grams and in the same order in which the corresponding catalysts are listed.
[8]The water also contained 10 grams of ethanol.
[9]The water also contained 10 grams of 1-hexene.
[10]The water also contained 20 grams of ethanol.
[11]The water also contained 30 grams of ethanol.

TABLE 17

| Example | Gas | Product Composition[1] Light Ends | Heavy Ends | Solids | Percent Removal of[2] Sulfur | Nickel | Vanadium | Mass Balance[3] |
|---|---|---|---|---|---|---|---|---|
| 156 | 6.7 | 32.3 | 58.0 | 3.0 | 84.7 | 92.6 | 20.5 | 100.6 |
| 157 | 13.1 | 34.0 | 47.6 | 5.3 | 56.7 | 66.7 | 76.5 | 100.5 |
| 158 | 1.3 | 29.7 | 60.8 | 8.2 | 90.0 | 96.0 | 24.0 | 100.1 |
| 159 | 7.3 | 55.6 | 27.3 | 10.0 | 36.2 | — | — | 100.7 |
| 160 | 4.6 | 49.9 | 33.0 | 12.0 | 26.9 | — | — | 100.6 |
| 161 | 7.0 | 6.4 | 83.9 | 9.3 | 21.3 | — | — | 99.8 |
| 162 | — | — | 33.3 | 11.8 | — | — | — | — |
| 163 | — | — | 44.5 | 28.3 | — | — | — | — |
| 164 | — | — | — | 6.3 | — | — | — | — |
| 165 | — | 66.6 | 24.3 | 13.4 | — | — | — | — |
| 166 | — | — | 79.0 | 6.7 | — | — | — | — |
| 167 | — | — | 42.0 | 5.7 | — | — | — | — |
| 168 | — | 55.0 | 35.2 | 10.0 | — | — | — | — |
| 169 | 1.7 | 53.5 | 41.6 | 7.7 | 53.0 | 96.0 | 24.0 | 100.5 |
| 170 | 0.3 | 64.2 | 33.7 | 5.7 | 68.0 | 87.4 | 0 | 101.6 |
| 171 | 3.6 | 47.6 | 44.1 | 2.7 | 76.0 | 99.0 | 0 | 99.2 |
| 172 | 0 | 23.0 | 75.5 | 1.8 | 80.2 | 95.0 | 17.0 | 99.8 |

[1]weight percent of the hydrocarbon feed.
[2]These values were obtained from analyses of the combined light and heavy ends.
[3]weight percent of hydrocarbon and water feed and catalyst recovered as product and water.

The products included gases in the amount of 10.1 liters at normal temperature and pressure and 14.3 grams of liquid hydrocarbon product. The gas products were made up primarily of argon and contained 6.56 weight percent of carbon dioxide and 1.13 weight percent of methane. The amount of hexane in the product constituted 46.6 weight percent of the 1-hexene feed. The liquid hydrocarbon product contained 888 parts per million of nitrogen, for a 93 percent removal of nitrogen from the hydrocarbon feed.

Examples 174–176 illustrate that the catalyst of the method of this invention is nitrogen-resistant and involve 4-hour batch runs in a 300-milliliter Hastelloy alloy B Magne-Dash autocalve. In each of these examples, 12.8 grams of 1-hexene were processed with 90 grams of water at a reaction temperature of 662°F., under an argon pressure of 650 pounds per square inch gauge and in the presence of 2.0 grams of silicon dioxide containing 5 weight percent of ruthenium catalyst. The supported catalyst had been calcined in oxygen for 4 hours at 550°C. Examples 174, 175, and 176 were performed under a reaction pressure of 3500, 3500, and 3400 pounds per square inch gauge, respectively. The reaction mixture in Examples 175 and 176 included additionally 1 milliliter (0.97 grams) of pyrrole. Example 176 was performed under identical conditions as those used in Example 175. Additionally, the same catalyst used in Example 175 was re-used in Example 176. The yields of hexane in Examples 174, 175, and 176 were 16.6, 14.0, and 13.9 weight percent of the 1-hexene feed, respectively. Within the ordinary experimental error of this work, these yields indicate no nitrogen poisoning.

EXAMPLES 177–186

Figure 3:
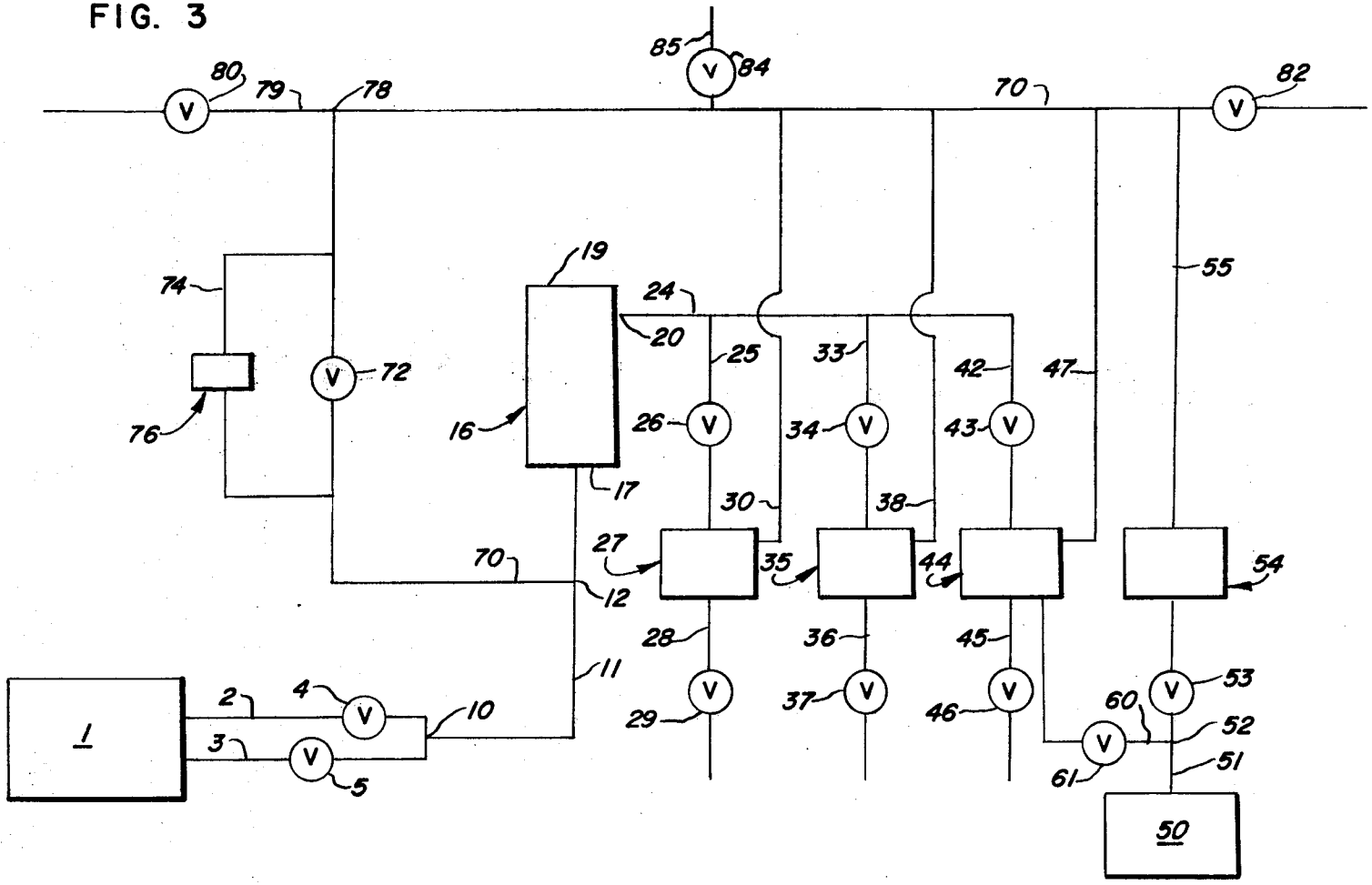
FIG. 3 is a schematic diagram of the flow system used for semicontinuously processing a hydrocarbon fraction.

Examples 177–186 involve semi-continuous flow processing at 752°F. of straight tar sands oil under a variety of conditions. The flow system used in these Examples is shown in FIG. 3. To start a run, either ⅛-inch diameter inert, spherical alundum balls or irregularly shaped titanium oxide chips having 2 weight percent of ruthenium catalyst deposited thereon were packed through top 19 into a 21.5-inch long, 1-inch outside diameter and 0.25-inch inside diameter vertical Hastelloy alloy C pipe reactor 16. Top 19 was then closed and a furnace (not shown) was placed around the length of pipe reactor 16. Pipe reactor 16 had a total effective heated volume of about 12 milliliters, and the packing material had a total effective heated volume of about 6 milliliters, leaving approximately a 6-milliliter effective heated free space in pipe reactor 16.

All valves, except 53 and 61, were opened, and the flow system as flushed with argon or nitrogen. Then, with valves 4, 5, 29, 37, 46, 53, 61, and 84 closed and with Annin valve 82 set to release gas from the flow system when the desired pressure in the system was exceeded, the flow system was brought up to a pressure in the range of from about 1000 to about 2000 pounds per square inch gauge by argon or nitrogen entering the system through valve 80 and line 79. Then valve 80 was closed. Next, the pressure of the flow systen was brought up to the desired reaction pressure by opening valve 53 and pumping water through Haskel pump 50 and line 51 into water tank 54. The water served to further compress the gas in the flow system and thereby to further increase the pressure in the system. If a greater volume of water than the volume of water tank 51 was needed to raise the pressure of the flow system to the desired level, then valve 61 was opened and additional water was pumped through line 60 and into dump tank 44. When the pressure of the flow system reached the desired pressure, valves 53 and 61 were closed.

A Ruska pump 1 was used to pump the hydrocarbon fraction and water into pipe reactor 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels were manually turned on until the pressure in each barrel equaled the pressure of the flow system. When the pressures in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flowed through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches from bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed and valve 34 was opened for the desired period of time to permit the mixture in side arm 24 to flow though line 33 and to enter and be stored in product receiver 35. After collecting a batch of product in receiver 35 for the desired period of time, valve 34 was closed and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gases and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of products were to be collected, valve 29 and/or valve 37 was opened to remove product from product receiver 27 and/or 35, respectively, to permit the same product receiver and/or receivers to be used to collect additional batches of product.

At the end of a run — during which the desired number of batches of product were collected — the temperature or pipe reactor 16 was lowered to ambient temperature and the flow system was depressurized by opening valve 84 in line 85 venting to the atmosphere.

Diaphragm 76 measured the pressure differential across the length of pipe reactor 16. No solution flowed through line 74.

The API gravity of the liquid products collected were measured, and their nickel, vanadium, and iron contents were determined by X-ray fluorescence.

The properties of the straight tar sands oil feed employed in Examples 177–186 are shown in Table 5. The tar sands oil feed contained 300–500 parts per million of iron, and the amount of 300 parts per million was used to determine the percent iron removed in the product. The experimental conditions and characteristics of the products formed in these Examples are presented in Table 18. The liquid hourly space velocity (LHSV) was calculated by dividing the total volumetric flow rate in milliliters per hour, of water and oil feed passing through pipe reactor 16 by the volumetric free space in pipe reactor 16 — that is, 6 milliliters.

The above examples are presented only by way of illustration, and the invention should not be construed as limited thereto. The various components of the catalyst system of the method of this invention do not possess exactly identical effectiveness. The most advantageous selection of these components and their concentrations and of the other reaction conditions will depend on the particular feed being processed.

TABLE 18

| | Example 177 | Example 178 | Example 179 | Example 180 | Example 181 | Example 182 | Example 183 | Example 184 | Example 185 | Example 186 |
|---|---|---|---|---|---|---|---|---|---|---|
| Reaction pressure[1] | 4100 | 4040 | 4060 | 4080 | 4100 | 4100 | 4100 | 4100 | 4020 | 4040 |
| LHSV[2] | 1.0 | 1.0 | 1.0 | 1.0 | 2.0 | 2.0 | 2.0 | 2.0 | 2.0 | 2.0 |
| Oil-to-water volumetric flow rate ratio | 1:3 | 1:3 | 1:3 | 1:3 | 1:2 | 1:2 | 1:3 | 1:3 | 1:3 | 1:3 |
| Packing material | alundum | Ru, Ti | Ru, Ti | Ru, Ti | alundum | alundum | alundum | alundum | Ru, Ti | Ru, Ti |
| Product collected during period number[3] | 3 | 2 | 4 | 5 | 1 | 2 | 1 + 2 | 3 | 2 | 3 |

TABLE 18-continued

| | Example 177 | Example 178 | Example 179 | Example 180 | Example 181 | Example 182 | Example 183 | Example 184 | Example 185 | Example 186 |
|---|---|---|---|---|---|---|---|---|---|---|
| Product characteristics | | | | | | | | | | |
| API gravity[4] | 21.0 | 21.0 | 23.0 | 20.0 | 17.8 | 17.3 | 21.0 | 22.9 | 20.0 | 20.0 |
| Percent nickel removed | 95 | 77 | 84 | 69 | 97 | 69 | 64 | 69 | 69 | 93 |
| Percent vanadium removed | 97 | 81 | 96 | 99 | 59 | 54 | 73 | 59 | 60 | 77 |
| Percent iron removed | 98 | 99 | 98 | 92 | — | — | 99 | 99 | 98 | 98 |

[1]pounds per square inch gauge.
[2]hours$^{-1}$.
[3]The number indicates the 7–8 hour period after start-up and during which feed flowed through pipe reactor 16.
[4]°API.

We claim:

1. A process for recovering upgraded products from coal solids, comprising contacting the coal solids with a water-containing fluid, to thereby produce gases, liquids, and upgraded solids from the coal solids, under super-atmospheric pressure, at a temperature in the range of from about 600°F. to about 900°F. in the absence of externally supplied hydrogen or other reducing gas, and in the presence of an externally supplied catalyst system containing a sulfur- and nitrogen-resistant catalyst, selected from the group consisting of at least one soluble or insoluble transition metal compound, a transition metal deposited on a support, and combinations thereof, wherein said catalyst is present in a catalytically effective amount, wherein said transition metal in said catalyst is selected from the group consisting of ruthenium, rhodium, iridium, osmium, and combinations thereof, and wherein sufficient water is present in the water-containing fluid and said pressure is sufficiently high so that the water in the water-containing fluid has a density of at least 0.10 gram per milliliter and serves as an effective solvent for the liquids and gases produced from the coal solids; and lowering said temperature or pressure or both, to thereby make the water in the water-containing fluid a less effective solvent for such liquids and gases and to thereby form separate phases.

2. The process of claim 1 wherein the density of water in the water-containing fluid is at least 0.15 gram per milliliter.

3. The process of claim 2 wherein the density of water in the water-containing fluid is at least 0.2 gram per milliliter.

4. The process of claim 1 wherein the temperature is at least 705°F.

5. The process of claim 1 wherein the coal solids and water-containing fluid are contacted for a period of time in the range of from about 1 minute to about 6 hours.

6. The process of claim 5 wherein the coal solids and water-containing fluid are contacted for a period of time in the range of from about 5 minutes to about 3 hours.

7. The process of claim 6 wherein the coal solids and water-containing fluid are contacted for a period of time in the range of from about 10 minutes to about 1 hour.

8. The process of claim 1 wherein the weight ratio of coal solids-to-water in the water-containing fluid is in the range of from about 3:2 to about 1:10.

9. The process of claim 8 wherein the weight ratio of coal solids-to-water in the water-containing fluid is in the range of from about 1:1 to about 1:3.

10. The process of claim 1 wherein the water-containing fluid is substantially water.

11. The process of claim 1 wherein the water-containing fluid is water.

12. The process of claim 1 wherein the coal solids have a maximum particle size of one-half inch diameter.

13. The process of claim 12 wherein the coal solids have a maximum particle size of one-quarter inch diameter.

14. The process of claim 13 wherein the coal solids have a maximum particle size of 8 mesh.

15. The process of claim 1 wherein the water-containing fluid contains an organic material selected from the group consisting of biphenyl, pyridine, a highly saturated oil, an aromatic oil, a partly hydrogenated aromatic oil, and a mono- or polyhydric compound.

16. The process of claim 15 wherein the water-containing fluid contains an organic material selected from the group consisting of biphenyl, pyridine, a highly saturated oil, and a mono- or polyhydric compound.

17. The process of claim 16 wherein the water-containing fluid contains a highly saturated oil.

18. The process of claim 1 wherein the catalyst is present in a catalytically effective amount which is equivalent to a concentration level in the water-containing fluid in the range of from about 0.02 to about 1.0 weight percent.

19. The process of claim 18 wherein the catalyst is present in a catalytically effective amount which is equivalent to a concentration level in the water-containing fluid in the range of from about 0.05 to about 0.15 weight percent.

20. The process of claim 1 wherein the catalyst system contains additionally a promoter selected from the group consisting of at least one basic metal hydroxide, basic metal carbonate, transition metal oxide, oxide-forming transition metal salt, and combinations thereof, wherein the metal in the basic metal carbonate and hydroxide is selected from the group consisting of alkali metals, wherein the transition metal in the oxide and salt is selected from the group consisting of the transition metals of Groups IVB, VB, VIB, and VIIB of the Periodic Chart, and wherein said promoter promotes the activity of the catalyst.

21. The process of claim 20 wherein the transition metal in the oxide and salt is selected from the group consisting of vanadium, chromium, manganese, titanium, molybdenum, zirconium, niobium, tantalum, rhenium, and tungsten.

22. The process of claim 21 wherein the transition metal in the oxide and salt is selected from the group consisting of chromium, manganese, titanium, tantalum, and tungsten.

23. The process of claim 20 wherein the metal in the basic metal carbonate and hydroxide is selected from the group consisting of sodium and potassium.

24. The process of claim 20 wherein the ratio of the number of atoms of metal in the promoter to the number of atoms of metal in the catalyst is in the range of from about 0.5 to about 50.

25. The process of claim 24 wherein the ratio of the number of atoms of metal in the promoter to the number of atoms of metal in the catalyst is in the range of from about 3 to about 5.

* * * * *

UNITED STATES PATENT OFFICE
CERTIFICATE OF CORRECTION

Patent No. 3,983,028 Dated September 28, 1976

Inventor(s) John D. McCollum and Leonard M. Quick

It is certified that error appears in the above-identified patent and that said Letters Patent are hereby corrected as shown below:

Column 6, line 32, "100" should be -- 1000 --.

Column 7, line 1, "rage" should be -- range --.

Column 7, lines 57-58, delete "the recovering liquids and gases from coal, cracking and desulfurizing".

Column 8, line 4, "rage" should be -- range --.

Column 9, line 60, "materials" should be -- materials, --.

Column 9, line 60, "ad" should be -- and --.

Column 10, line 28, "range from about" should be -- range of from about --.

Column 10, line 58, "effectivee" should be -- effective --.

Column 10, line 59, "andd" should be -- and --.

Column 10, line 66, "preferably 1/2-inch" should be -- preferably of 1/2-inch --.

Column 11, line 9, "andd" should be -- and --.

Column 14, line 2, in Table 2, "Coal-to Water weight Ratio" should be -- Coal-to-Water Weight Ratio --.

UNITED STATES PATENT OFFICE
CERTIFICATE OF CORRECTION

Patent No. 3,983,028 Dated September 28, 1976

Inventor(s) John D. McCollum and Leonard M. Quick

It is certified that error appears in the above-identified patent and that said Letters Patent are hereby corrected as shown below:

Column 13, in Footnote 10, "removed catalytic" should be
-- removed from catalytic --.

Column 15, line 67, "andd" should be -- and --.

Column 16, line 48, "andd" should be -- and --.

Column 16, line 65, "andd" should be -- and --.

Column 17, line 10, in Table 5, "Kafji" should be
-- Khafji --.

Column 19, line 37, "or" should be -- of --.

Column 20, line 54, "There" should start a new paragraph.

Column 21, line 48, "transistion" should be
-- transition --.

Column 23, line 29, in Table 9, "$RnCl_3 \cdot 3H_2O$" should be
-- $RhCl_3 \cdot 3H_2O$ --.

Column 24, in Footnote 4 of Table 10, "parenthesis" should be
-- parentheses --.

Column 27, line 34, in Table 13, "Reaction Time" should be
-- Reaction Time[1] --.

Column 28, line 7, "that that" should be -- than that --.

UNITED STATES PATENT OFFICE
CERTIFICATE OF CORRECTION

Patent No. 3,983,028 Dated September 28, 1976

Inventor(s) John D. McCollum and Leonard M. Quick

It is certified that error appears in the above-identified patent and that said Letters Patent are hereby corrected as shown below:

Column 28, line 45, "is" should be -- are --.

Column 30, in Table 14, Example 128, under the heading "Catalyst", "Ru, Os" should be -- Ru, Os, --.

Column 30, in Table 14, Example 146, under the heading "Catalyst", "Rh, Os" should be -- Ru, Os --.

Column 29, in Footnote 4 of Table 14, "$OsCl_3 \cdot H_2O$" should be -- $OsCl_3 \cdot 3H_2O$ --.

Column 32, line 50, "results" should be -- resulted --.

Signed and Sealed this

*Twenty-fourth* Day of *August 1982*

[SEAL]

*Attest:*

GERALD J. MOSSINGHOFF

*Attesting Officer* *Commissioner of Patents and Trademarks*